US008139995B1

(12) United States Patent
Fujita et al.

(10) Patent No.: US 8,139,995 B1
(45) Date of Patent: Mar. 20, 2012

(54) IMAGE FORMING APPARATUS

(75) Inventors: Takashi Fujita, Kashiwa (JP); Hiromasa Katayama, Toride (JP); Koji Nojima, Abiko (JP); Kiyoshi Oyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/299,937

(22) Filed: Nov. 18, 2011

Related U.S. Application Data

(63) Continuation of application No. 11/679,424, filed on Feb. 27, 2007.

(30) Foreign Application Priority Data

Feb. 28, 2006 (JP) ..... 2006-053260
Mar. 27, 2006 (JP) ..... 2006-085851

(51) Int. Cl.
*G03G 15/00* (2006.01)
*G03G 21/20* (2006.01)

(52) U.S. Cl. ..... 399/390; 399/92; 399/93; 399/98; 399/407

(58) Field of Classification Search ..... 399/92, 399/93, 98, 390, 407
See application file for complete search history.

(56) References Cited

U.S. PATENT DOCUMENTS

| | | | | |
|---|---|---|---|---|
| 6,094,549 | A | 7/2000 | Hiraoka et al. | |
| 7,167,659 | B2 | 1/2007 | Fujita et al. | |
| 7,286,784 | B2 * | 10/2007 | Tanaka | 399/92 |
| 7,668,476 | B2 * | 2/2010 | Kasai et al. | 399/93 |
| 2004/0047646 | A1 | 3/2004 | Yon et al. | |
| 2006/0083666 | A1 | 4/2006 | Katayama | |
| 2006/0289482 | A1 | 12/2006 | Nojima | |
| 2007/0059005 | A1 | 3/2007 | Fujita et al. | |
| 2007/0059061 | A1 | 3/2007 | Katayama et al. | |
| 2007/0059062 | A1 | 3/2007 | Endo et al. | |
| 2007/0059064 | A1 | 3/2007 | Okuda et al. | |
| 2007/0121142 | A1 | 5/2007 | Kasai et al. | |

FOREIGN PATENT DOCUMENTS

| | | | |
|---|---|---|---|
| JP | 3-238473 | A | 10/1991 |
| JP | 6-19264 | A | 1/1994 |
| JP | 11-161122 | A | 6/1999 |
| JP | 2000-235338 | A | 8/2000 |
| JP | 2001-80130 | A | 3/2001 |
| JP | 2002-167106 | A | 6/2002 |
| JP | 2002-258724 | A | 9/2002 |
| JP | 2004-184474 | A | 7/2004 |
| JP | 2004-240270 | A | 8/2004 |
| JP | 2004-264641 | A | 9/2004 |
| JP | 2005-126191 | A | 5/2005 |
| JP | 2007-171913 | A | 7/2007 |
| JP | 2007-183391 | A | 7/2007 |

OTHER PUBLICATIONS

Japanese Office Action dated Aug. 9, 2011, in Japanese Application No. 2006-053260.

* cited by examiner

*Primary Examiner* — Judy Nguyen
*Assistant Examiner* — Andy Pham
(74) *Attorney, Agent, or Firm* — Fitzpatrick, Cella, Harper & Scinto

(57) ABSTRACT

To remove also VOC gas generated from the discharged sheets, an image forming apparatus comprises an image forming unit which forms an image on a sheet; a tray on which sheets on which images are formed by the image forming unit are stacked; a suction device which sucks air from the surrounding space of sheets stacked up on the tray; and a VOC removing unit which removes VOC contained in the air sucked by the sucking device.

8 Claims, 17 Drawing Sheets

IMAGE FORMING APPARATUS

This is a continuation of U.S. patent application Ser. No. 11/679,424, filed Feb. 27, 2007, now pending.

BACKGROUND OF THE INVENTION

1. Field of the Invention

The invention relates to an image forming apparatus.

2. Description of the Related Art

An image forming apparatus such as copying machine and printer is designed to transfer toner and ink on a recording paper, and discharge it out of the machine and stack up on a tray. An image forming apparatus of electrophotographic system for transferring the toner on the paper comprises a heat-fixing device for thermally fixing the toner on the paper while gripping and conveying the paper on which the toner is transferred between contacting parts of a heating roller having a heater inside and a pressure roller.

The heating roller of the heat-fixing device is heated closely to 200° C., and so-called VOC (volatile organic compounds) gas may be generated from the heat-fixing device. Typical examples of VOC include alcohol, toluene, benzene, and styrene. That is, VOC is a generic name of organic compounds having volatile properties. An example of VOC gas generated from the heat-fixing device is methyl mercaptan generated from silicone oil used in the heating roller. When a styrene-based resin material is used in the thermal fixing device or its neighboring parts, styrene is generated from the resin material. Silicone oil and resin material hardly generate VOC gas at room temperature, but when heated, components are partly vaporized (or the VOC gas contained as fine bubbles in the material is expanded), and VOC gas may be generated.

Such VOC gas is not always a serious problem, but it becomes a problem even if a slightest malodor is contained or type of gas regulated by emission control law is generated. Methyl mercaptan belongs to the former type, and styrene belongs to the latter type. It has been hence proposed to remove VOC gas by providing the image forming apparatus with a filter (see, for example, Japanese Patent Application Laid-Open (JP-A) No. 11-161122).

JP-A No. 11-161122 discloses an apparatus for decomposing ozone generated in charger and charge removing device and mercaptan generated in fixing device by reaction, and discharging emission gas containing decomposition gas out of the apparatus.

It is also proposed to mix the ozone generated in the apparatus and air containing VOC, and to decompose the VOC by oxidation reaction (see, for example, JP-A No. 6-19264).

According to the above-descried conventional image forming apparatus, the VOC gas generated in: the apparatus can be removed by the catalytic filter. However, the VOC gas is generated also from the toner and paper, and is also generated continuously for a specific time from the paper on which the image is formed discharged outside of the apparatus (until the paper is cooled to specified temperature).

The VOC gas generated from the toner and paper is not so serious as to have adverse effects on human health, and does not release any peculiar malodors.

However, by color processing of image forming apparatus (increase of used amount of color toners) and high speed processing, the amount of VOC gas generated from the toner and paper tends to increase. Further more, the variety of paper used by recent users is diversified, and a large amount of VOC gas may be generated in future depending on the type of paper.

As the VOC gas increases, the smell may be regarded as a problem by the user if adverse effects are not caused on human health. Considering the recent trend of enforcing regulations of environmental law, the output of VOC gas may exceed the reference value.

In consideration of these backgrounds, in future, it may be required to remove VOC gas generated from paper and toner. In the conventional image forming apparatus, the VOC gas generated from the output paper is released into the space outside of the apparatus.

SUMMARY OF THE INVENTION

It is hence an object of the invention to remove also VOC gas generated from the discharged sheets.

An image forming apparatus according to the present invention comprises:

an image forming unit which forms an image on a sheet;

a tray on which sheets on which images are formed by the image forming unit are stacked;

a suction device which sucks air from the surrounding space of sheets stacked up on the tray; and a VOC removing unit which removes VOC contained in the air sucked by the sucking device.

It is therefore possible to remove VOC gas contained in the air around the sheet materials on which images are formed, being stacked up on the tray.

DESCRIPTION OF THE PREFERRED EMBODIMENTS

Figure 1A:
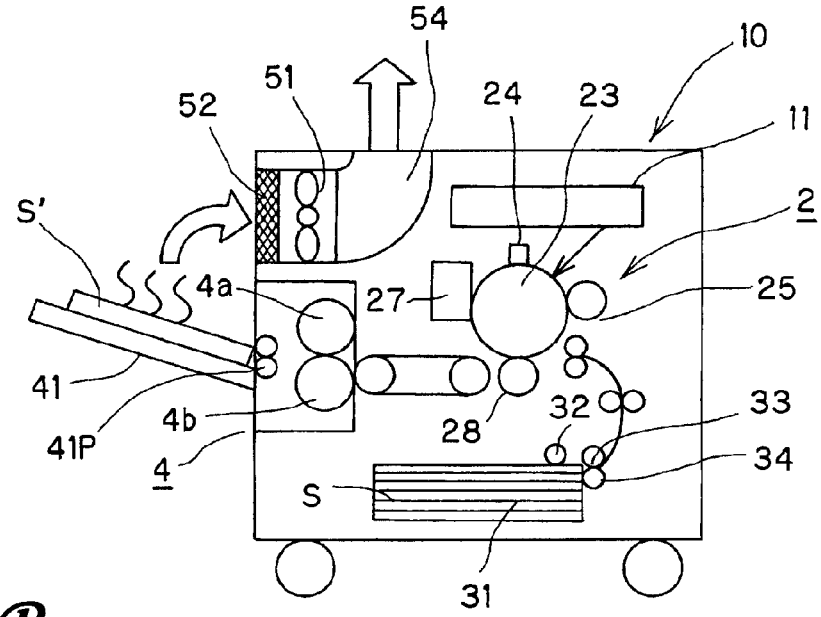
FIG. 1A is a sectional view of image forming apparatus according to the first embodiment of the invention.

Referring now to the drawings, preferred embodiments of the invention are described. Throughout the drawings, same or corresponding parts are identified with same reference numerals.

First Embodiment

Figure 1B:
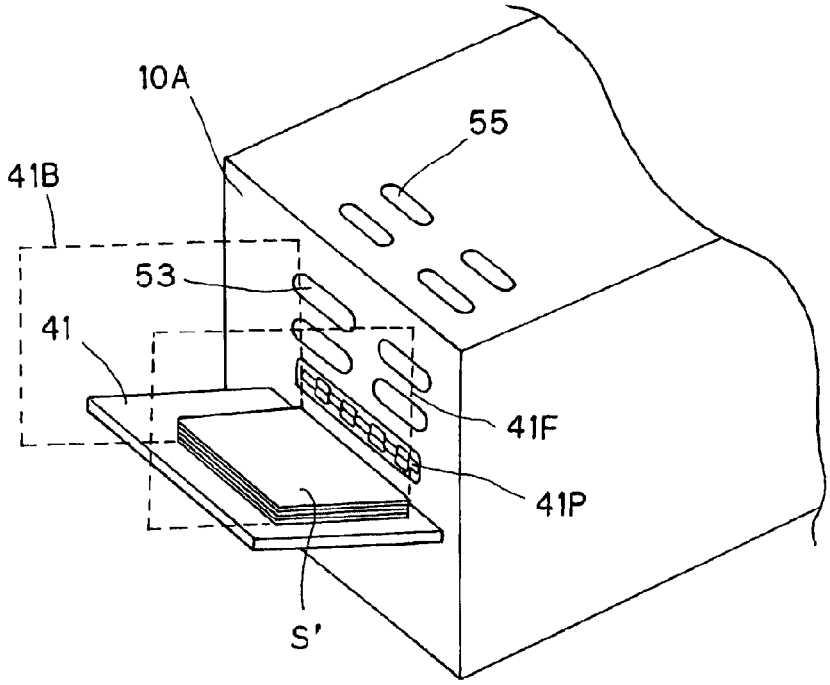
FIG. 1B is a perspective view near discharge tray in FIG. 1A.
Figure 2:
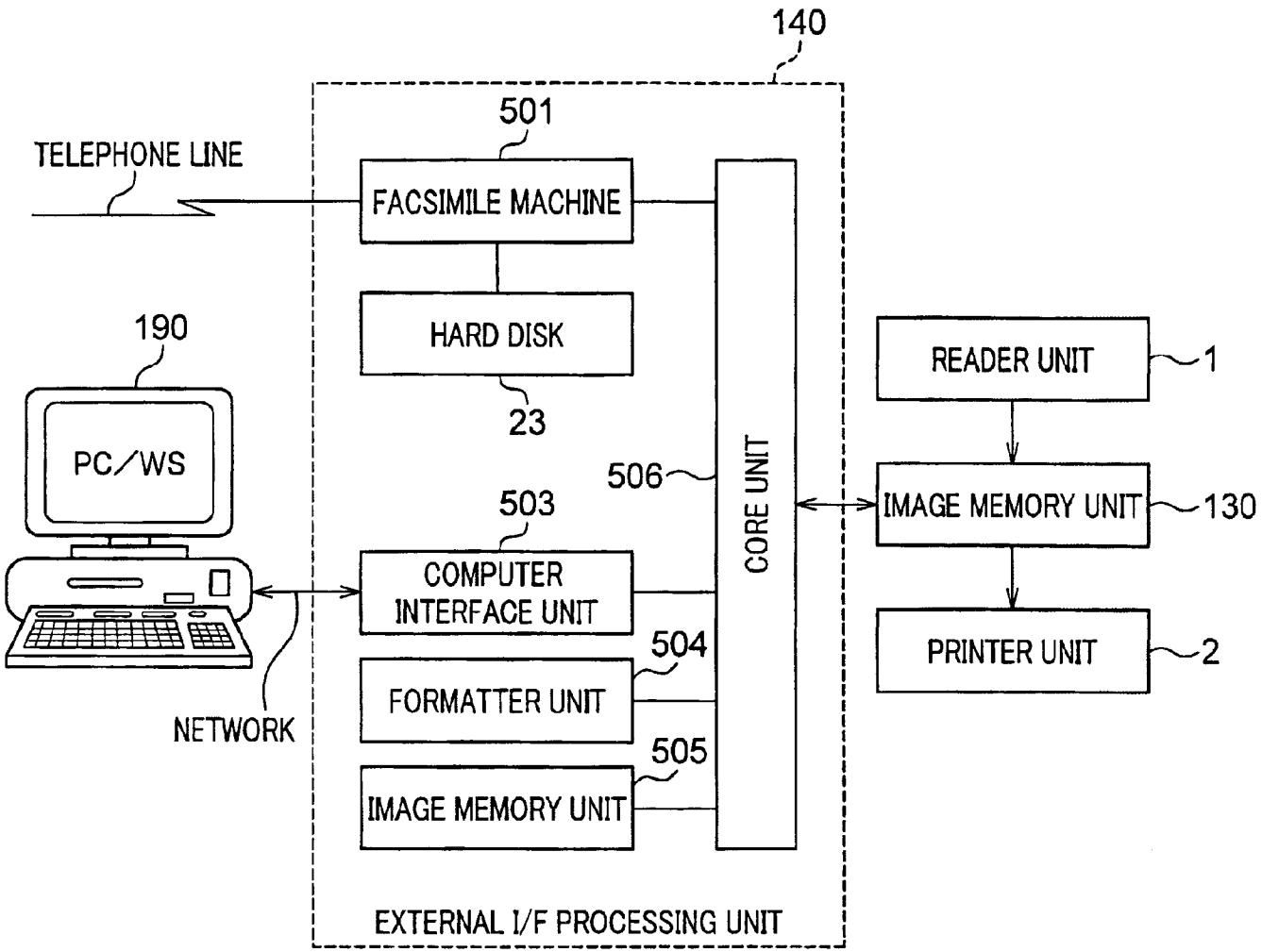
FIG. 2 is a block diagram of internal structure and peripheral device of I/F processing unit according to the first embodiment of the invention.
Figure 3:
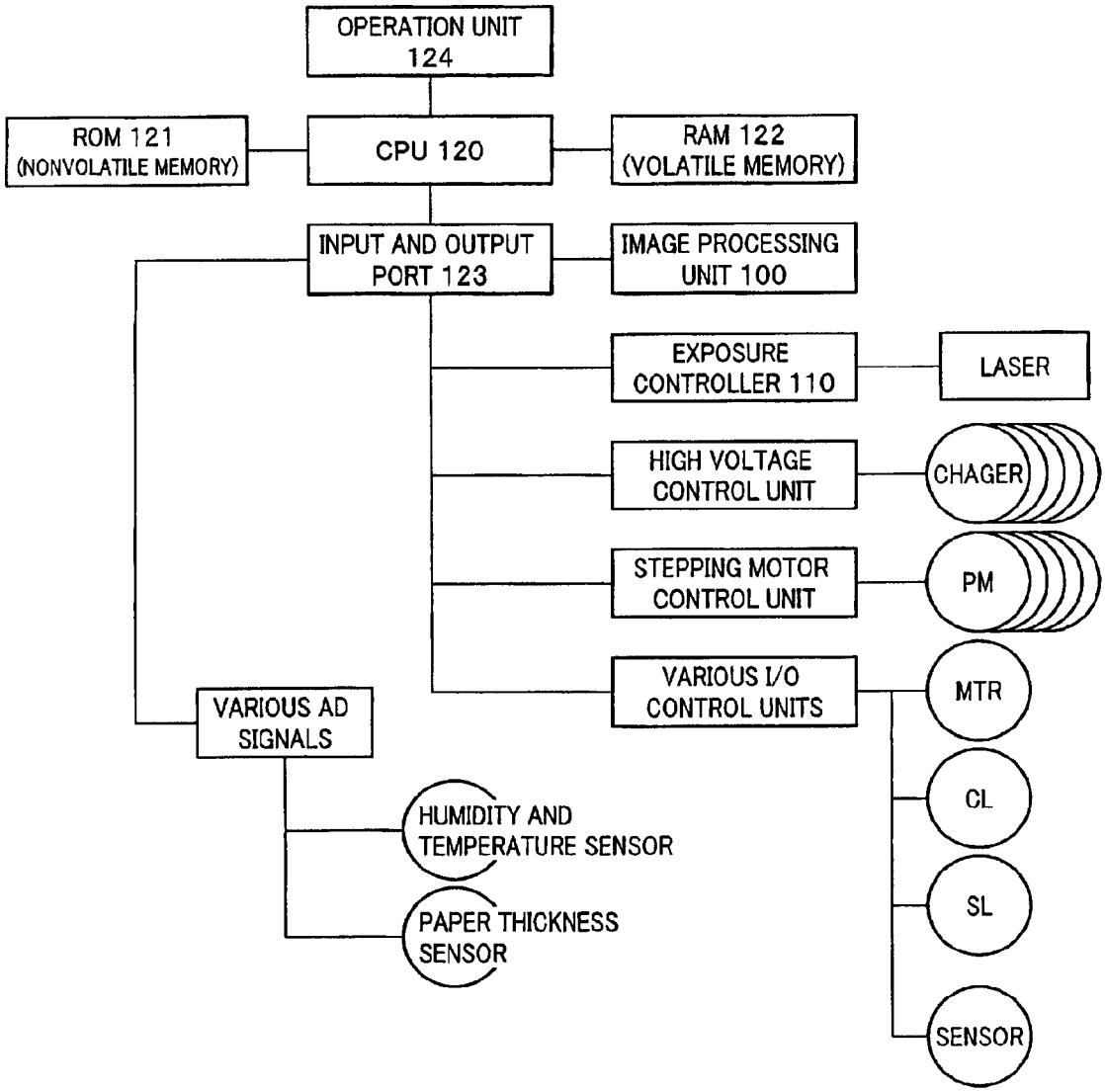
FIG. 3 is a block diagram of operation control unit of image forming apparatus shown in FIG. 1.

The first embodiment of the invention is described with referring to the drawings. FIG. 1 to FIG. 3 show an image forming apparatus according to the first embodiment of the invention. The image forming apparatus of the first embodiment is used as an information output printer from computer, facsimile machine or reader. First, referring to FIG. 2, the internal structure and peripheral device of external I/F processing unit 140 are explained.

(Communication Unit and Image Processing Unit)

The external I/F processing unit 140 takes in image data from a reader unit 1 by way of image memory unit 130, and sends image data to external computer or external facsimile machine by way of network or telephone line. Furthermore, image data sent from external computer or external facsimile machine by way of network or telephone line is outputted to the printer unit by way of image memory unit 130 (and image processing unit 170) to form an image.

The external I/F processing unit 140 comprises a core unit 506, a facsimile unit 501, a hard disk 502 for saving communication image data of facsimile unit 501, a computer interface unit 503 for connecting with an external computer 190, a format unit 504, and an image memory unit 505.

The facsimile unit 501 is connected to a public telephone line by way of a modem (not shown), and receives facsimile communication data from the public telephone line, and transmits facsimile communication data to the public telephone line. The facsimile unit 501 realizes the facsimile functions of sending facsimile machine at a specified time, or sending image data according to the inquiry by using a specified password from a partner, by making use of facsimile images stored in the hard disk 502.

Accordingly, once the image is sent from the reader unit 1 to the facsimile unit 501 by way of image memory unit 130, and image is stored in the hard disk 502 for facsimile machine, and the facsimile data can be transmitted without using the reader unit 1 and image memory 130 in the facsimile function.

The computer interface unit 503 is an interface unit for communicating data with external computer 190, and includes a local area network (LAN), serial I/F, SCSI-I/F, centro-I/F for printer data input and output, and others. By way of this computer interface unit 503, the state of image forming unit 2 and reader unit 1 is noticed to external computer 190. Or by an instruction from external computer 190, the image read out by the reader unit 1 is transferred to the external computer 190.

The computer interface unit 503 receives print image data from external computer 190. At this time, since the print image data noticed from the external computer 190 is described in dedicated printer code, and in the formatter unit 504 the noticed data code is converted into raster image so that an image can be formed in the image forming unit 2. The converted raster image is developed into the image memory unit 505 by the formatter unit 504. On the other hand, when transmitting image data to the external computer 190 by way of the computer interface unit 503, the formatter unit 504 processes the print image data sent from the image memory unit 130 by converting the concentration in the image memory unit 505, and converts into an image format that can be recognized in the external computer 190.

The image memory unit 505 is used as the memory for developing raster image data of the formatter 504, and is also used when sending the image data from the reader unit 1 into the external computer 190 (network scanner function).

That is, when the image from the reader unit 1 is sent to the external computer 190 by way of computer interface unit 503, the image data sent from the image memory unit 130 is once developed in the image memory unit 505, and is converted into a data format to be sent to the external computer 190, and is sent out to the external computer 190 from the computer interface unit 503.

The core unit 506 controls and manages respective data transfer among facsimile unit 501, computer interface unit 503, formatter unit 504, image memory unit 505, and image memory unit 130. Accordingly, even if a plurality of image output units are connected to the external I/F processing unit 140, or even if there is only one image transfer path to the image memory unit 130, dedicated control or priority control can be executed under the management of the core unit 506, and the image output is properly performed.

When printing the accumulated images, first, the image data is sent from the image memory unit 130 to the γ correction unit in the image processing unit 170. In the γ correction unit, on every output corresponding to the preset value of concentration, the original concentration data is converted into concentration data corresponding to the desired output concentration on the basis of the lookup table (LUT) in consideration with the property of the printer.

The exposure controller 110 controls the emission timing of laser 21 on the photosensitive drum 23 of respective colors, and forms an electrostatic latent image of image data.

(Main Body Controller Unit)

FIG. 3 is a block diagram of operation control unit of the image forming apparatus. The CPU 120 is an information processing circuit for basic control of image forming apparatus. The CPU 120 has a ROM 121 in which control program is written, a work RAM 122 for processing, and input and output port 123, connected by way of address bus and data bus. A partial region of RAM 122 is a backup RAM in which data is not erased even if the power is cut off. The input and output port 123 is the connection port for motor controlled by image forming apparatus, various load devices such as clutch, and input and output unit such as a sensor for detecting the position of paper.

The CPU 120 sequentially controls input and output by way of input and output port 123 according to the contents of the control program of the ROM 121, and executes the image forming process An operation unit 124 is connected to the CPU 120, and the CPU 120 controls the display means and key input means of operation unit 124. The user manipulates the key input means, and instructs an image forming operation mode or a display changeover to the CPU 120, and the CPU 120 displays the operation state of the image forming apparatus and operation mode determined by key input, to the display means of the operation unit 124.

Next, the image forming apparatus of the invention is described below. FIG. 1 shows a schematic configuration of image forming apparatus. This image forming apparatus is a printer using an electrophotographic process. A series of electrophotographic process is known, and detailed description is omitted.

(Sheet Feeding Unit)

As shown in FIG. 1, beneath the image forming apparatus, a sheet cassette 31 storing a stacked sheet materials S is detachably installed. A solenoid (not shown) coupled to a pickup roller 32 is turned on while waiting, and the pickup roller 32 is spaced from the sheet material surface. Next, when the sheet material is fed, the solenoid is turned off, and the pickup roller 32 contacts with the sheet material surface.

Thereafter, the first sheet material is fed by the pickup roller 32 driven by rotation. Driving of pickup roller 32 is transmitted from conveyance roller 33 by way of the timing belt.

The picked sheet material is gripped and conveyed by conveyance roller 33 and retard roller 34. The conveyance roller 33 receives rotation and driving in the sheet material conveying direction, and the retard roller 34 is rotatably driven in the reverse direction to the conveying direction by way of torque limiter (not shown).

The leading end side of the first sheet material is only one between a pair of rollers, and the torque limiter is overcome by the frictional force of sheet material and roller, and the retard roller 34 rotates in the conveying direction. Next, when sheet materials are overlaid, and reach the gripping portions of both rollers, the frictional force of first sheet material and second sheet material are overcome by the torque limiter, and the retard roller 34 rotates reversely to the conveying direction, and only the uppermost sheet material is separated and supplied in advance. Even if a plurality of sheet materials is picked up at the same time, only the uppermost sheet material is separated and supplied in advance in similar operation.

By such a sheet feeding operation, stacked sheet materials can be supplied one by one.

(Convey Unit)

The sheet material is supplied by the sheet feeding unit 3, and its leading end is once stopped by a resist roller 20, and is supplied again together with the image formed by the image forming unit 2, and an image is transferred in the transfer unit. Rotary drive of resist roller 20 is executed by stepping motor (not shown), and it is controlled by controller of the main body.

(Image Forming Unit)

Corresponding with the image information from the exposure controller, a laser emitting unit (not shown) included in the laser scanner unit 11 emits laser light. By scanning in the generator direction of photosensitive drum 23 by rotation of polygon mirror (not shown), a latent image is formed on a drum surface previously charged by charger 24, the latent image is developed by a developing machine 25 provided around the photosensitive member drum 23, and a toner image is transferred on the sheet material at the nip portion of the transfer roller 28 in which electric field is applied. The toner remained on the drum surface after transfer of image is removed by a cleaning device 27.

In this embodiment, a printer forming a monochromatic image is presented, but the invention is similarly applicable to a printer for forming a color image by using a plurality of colors.

(Fixing Unit)

The sheet material S on which a toner image is transferred in the image forming unit 2 is sent into a fixing device 4, in which heat and pressure are applied when passing through fixing roller 4*a* and pressure roller 4*b*, and the toner image is fused on the sheet material S, and is discharged out of the image forming apparatus main body 10 by means of a discharge roller 41P. The discharged sheet material S' is sequentially stacked up on discharge tray 41 as sheet material stacking portion.

The fixing roller is controlled to, for example, about 180° C., and the temperature of the sheet material right after discharge from the image forming apparatus main body 10 is about 90° C. Since the heat of the sheet material is discharged before next sheet material is stacked up, the inside of the stacked sheet materials S' is kept at about 60° C. Basically, in the case of paper, since the insulating effect is high, it takes time until the temperature of the block of the stacked sheet materials S' is lowered. Therefore, after discharge, VOC is generated from the sheet materials S', and it is required to remove it.

The invention, therefore, as shown in FIG. 1, comprises a fan 51 as suction means for sucking air around the sheet material S' discharged from the image forming apparatus main body 10, and an active carbon filter 52 as purifying means for purifying volatile organic compounds contained in the air sucked by this fan 51, that is, VOC, and the air around the discharged sheet materials is sucked, purified, processed, and discharged outside. The filter 52 includes a VOC removing unit for removing VOC contained in the air.

In the first embodiment, the fan 51 and active carbon filter 52 are designed to discharge the purified air in the image forming apparatus main body 10 to outside from the image forming apparatus main body 10. That is, above the fixing unit, the fan 51 is provided for sucking the atmosphere containing the VOC of sheet materials stacked up on the discharge tray 41. The fan 51 is located above the discharge tray 41 as shown in FIG. 1B, and sucks air into the apparatus from a louver 53 (an opening) provided on the casing of the image forming apparatus main body 10. The louver 53 is formed in a lateral surface 10A of the apparatus having a discharge roller. At least one part of the louver 53 is provided in width direction (direction orthogonal to sheet discharge direction) of sheet materials stacked up on the discharge tray 41. That is, at least one part of the louver 53 is provided between virtual plane 41F passing end of width direction in the stacking portion of sheet materials in the discharge tray 41 on a plane orthogonal to width direction, and virtual plane 41B passing other end. In such configuration, the VOC generated from sheet materials S' stacked up on the discharge tray 41 is sucked into the apparatus by the fan 51 by way of the louver 53.

In the shown example, the active carbon filter 52 is disposed at the suction side front face of the fan, and air is sucked through the active carbon filter 52. By passing through the active carbon filter 52, the VOC is adsorbed and removed, and purified air is discharged outside of the apparatus from the louver 55 opened in the upper surface of the image forming apparatus main body 10 through a duct 54. In the diagram, the arrow shows the flow of air. Direction of discharge is not limited to the upper part, but the air may be discharged, for example, backward.

Figure 1C:
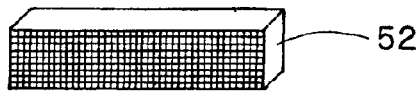
FIG. 1C is a perspective view of filter.

As shown in FIG. 1C, the active carbon filter 52 is increased in surface area and enhanced in VOC removing effect by affixing active carbon on a base material such as aluminum or corrugated fiberboard having mesh structure. At the upstream of the active carbon filter 52, a dust filter may be provided for preventing clogging of active carbon filter with dust or the like. The ozone and VOC generated in the image forming apparatus main body 10 are discharged outside of the apparatus by way of other active carbon filter than the aforementioned active carbon filter 52.

Next, the other embodiments of the invention are described below. In the following explanation, only different points from the first embodiment are described, and duplicate explanation of same parts is omitted.

First Modified Example of the First Embodiment

Figure 4:
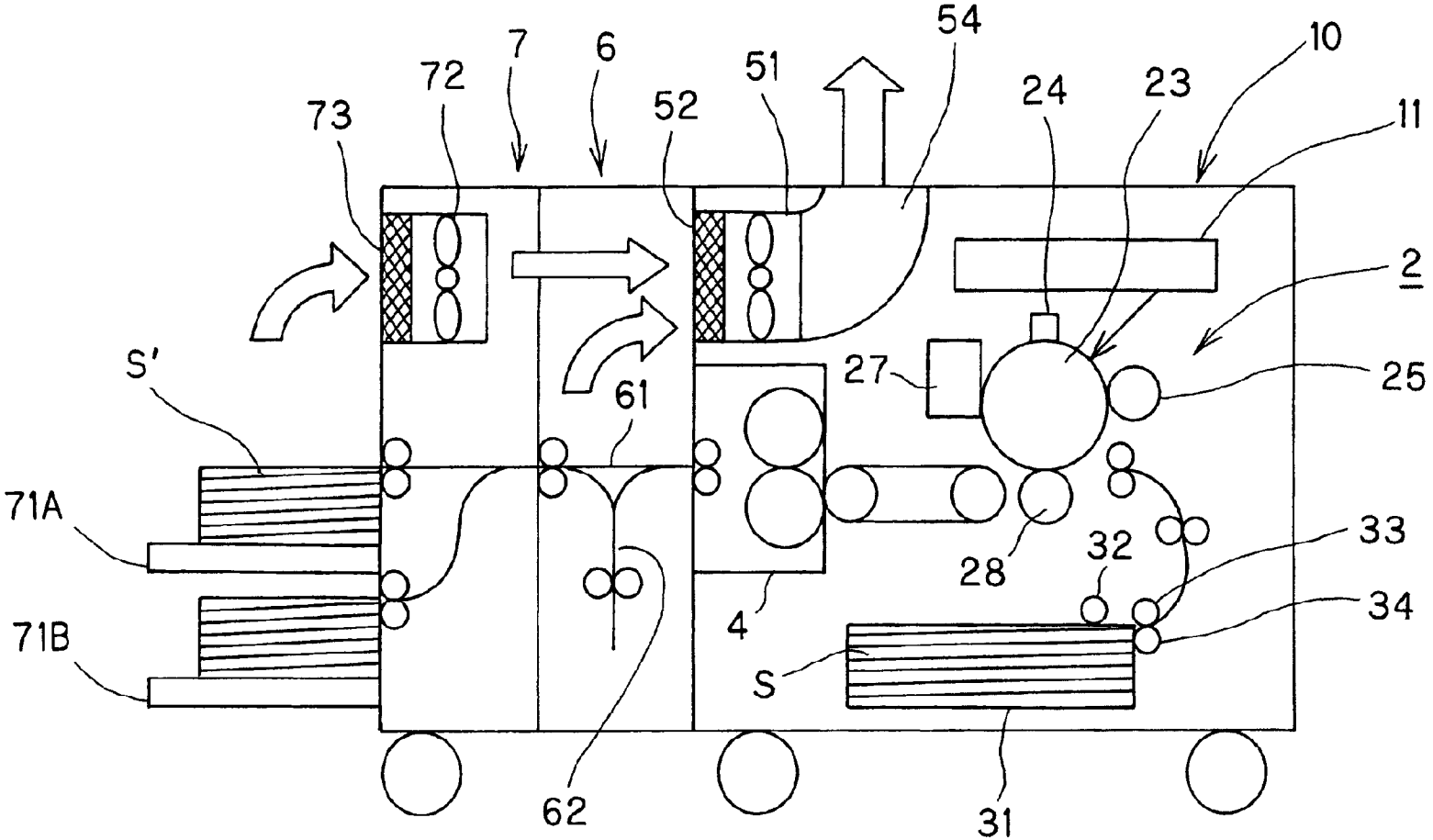
FIG. 4 is a schematic diagram, of first modified example of the first embodiment.

FIG. 4 shows an image forming apparatus according to the first modified example of the invention. In this first modified example, as shown in FIG. 4, a sheet material inverting device 6 and a stacker 7 are connected to the image forming apparatus main body 10 as a post-processing apparatus. The stacker 7 includes a stacker main body 71 having a branch path for branching the sheet material conveying path into upper and lower routes, and upper and lower discharge trays 71A, 71B as sheet material discharge units.

The sheet material discharged from the image forming apparatus main body 10 passes through the sheet material inverting device 6 and stacker 7, and is discharged into discharge trays 71A, 71B. The sheet material inverting device 6 turns the sheet material surface to the other side depending on the operation by the user, and when discharging the sheet face up, it passes through the conveying path 61, and when discharging the sheet face down, the sheet material is switched back by the inverting path 62, and face and back are inverted. The path is changed over by a command of the main body controller, and a deflection guide (not shown) is operated by a solenoid.

The stacker 7 increased in capacity can accommodate a large capacity in discharge trays 71A, 71B in upper and lower stages, and like the inverting path, a deflection guide (not shown) of the stacker main body 71 is operated by the main body controller, and the discharge trays can be changed over. For example, by changing over at every job, or by changing over by the output from the personal computer or by facsimile machine or other input source, the setting can be changed freely according to the preference of the user.

As same mentioned above, the sheet material discharged from the main body is high in temperature, and VOC is mixedly remained in the path of the sheet material inverting device 6 or stacker main body 71 or in the atmosphere near the sheet materials stacked up on the discharge trays 71A, 71B after sheet discharge. Since the discharge unit is at a longer distance than in the above example, the temperature at the time of stacking is lower, but since the stacking capacity is large, a greater insulating effect is needed and it takes time until the temperature is lowered, and all effects of temperature decline cannot be accepted by the total amount of VOC.

Accordingly, the air near the discharge trays 71A, 71B is sucked and purified, and also the air in the post-processing apparatus, that is, sheet material inverting device 6 and stacker main body 71 are sucked and purified. In this modified example, the position in width direction of at least one part of the louver 73 is in the width direction of the sheet materials S' stacked up on the discharge tray 71A.

In this modified example, as same in the foregoing embodiment, the fan 51 and active carbon filter 52 are provided in the image forming apparatus main body 10, and sheet material inverting device 6 and stacker main body 71 are provided with passages for inducting the air in the sheet material inverting device 6 and stacker main body 71 and the air near the discharge trays 71A, 71B into the image forming apparatus main body 10.

In this modified example, as shown in FIG. 4, an air passage is provided above the sheet material conveying path of sheet material inverting device 6 and stacker main body 71, and the atmosphere in the sheet material inverting device 6 and stacker main body 71 and discharge trays 71A, 71B is sucked by the fan 51 in the image forming apparatus main body 10, and the VOC is removed by the active carbon filter 52.

If the passage is too long and the suction force is not enough by the fan 51 alone, an auxiliary fan 72 may be provided in the post-processing apparatus as means for assisting the fan. In this embodiment, it is provided above the discharge trays 71A, 71B of the stacker main body 71, and the atmosphere near the sheet discharge unit is sucked, and sent into the image forming apparatus main body 10. An active carbon filter 73 is also provided at the front surface of the auxiliary fan 72. If the tightness of closure of each unit of sheet material inverting device 6 and stacker main body 71 is high, it is not necessary to consider the ratio of performance between fan 51 and auxiliary fan 72, but raising of the tightness of closure is actually difficult because the conveying path has to be succeeded.

At this time, in the case of (airflow of fan 51)<(airflow of auxiliary fan 72), air containing VOC gushes out from the gaps in the junction of the apparatus. In this embodiment, therefore, the airflow of the fan 51 at the image forming apparatus main body 10 side is set larger than the airflow of the auxiliary fan 72. In the embodiment, the voltage supplied to the fans is adjusted by using the same fans so that (airflow of fan 51)>(airflow of auxiliary fan 72).

Of course, the airflow may be adjusted by changing the performance of the fan. By the same fans and same voltage, the passage resistance can be varied by changing the mesh opening or thickness of the active carbon filter 52 and active carbon filter 73, and same effects are obtained.

Second Modified Example

Figure 5:
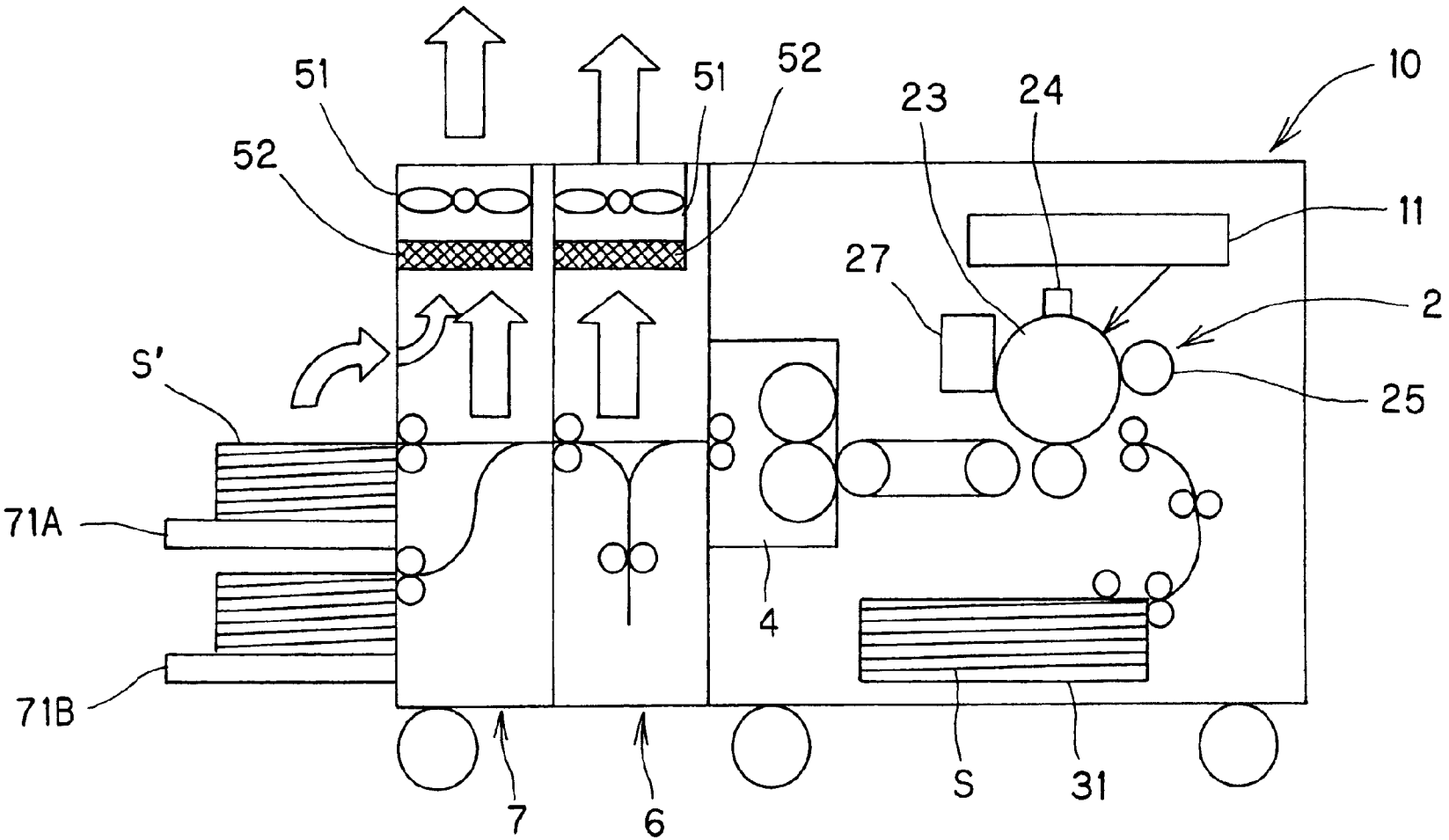
FIG. 5 is a schematic diagram of second modified example of the first embodiment.

FIG. 5 shows an image forming apparatus in the second modified example of the invention. In this second modified example, as same in the first modified example, a sheet material inverting device 6 and a stacker 7 are connected to the image forming apparatus main body 10 as post-processing apparatus. The stacker 7 includes a stacker main body 71 having a branch path for branching the sheet material conveying path into upper and lower routes, and upper and lower discharge trays 71A, 71B as sheet material discharge units.

In the second modified example, fan 51 and active carbon filter 52 are provided respectively in the stacker main body 71 and sheet material inverting device for composing the post-processing apparatus.

The air near the discharge trays 71A, 71B and in the stacker main body 71 is sucked and purified by the fan 51 and active carbon filter 52 provided in the stacker main body 71, and discharged outside. The air in the sheet material inverting device 6 is sucked and purified by the fan 51 and active carbon filter 52 provided in the sheet material inverting device 6, and discharged outside.

In the first and second modified examples, the sheet material inverting device 6 and stacker 7 are exemplified as post-processing apparatuses, but the invention may be similarly applied to other post-processing apparatus, such as puncher, folding machine, binder, and finisher.

Third Modified Example

Figure 6:
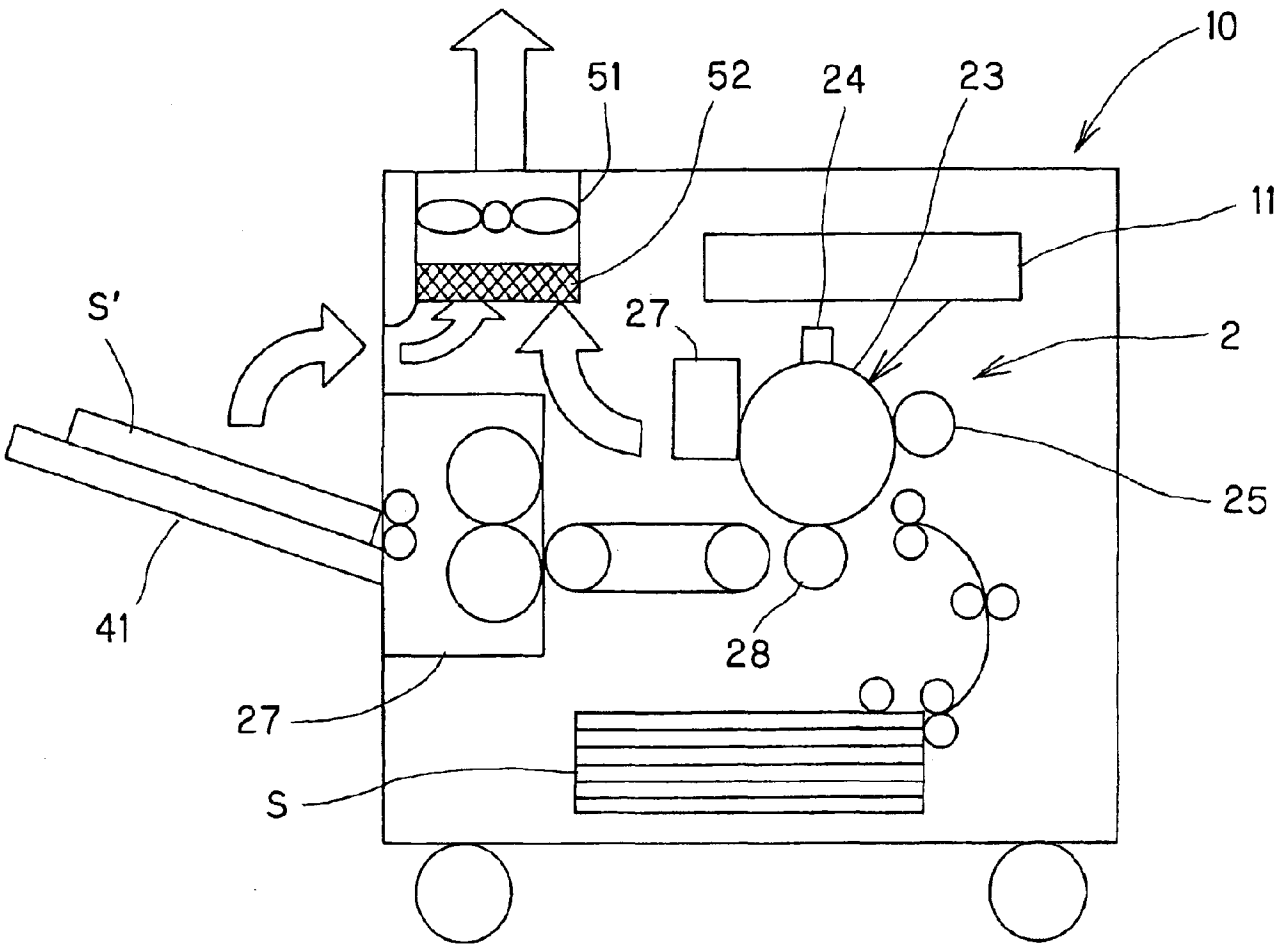
FIG. 6 is a schematic diagram of third modified example of the first embodiment.

FIG. 6 shows an image forming apparatus in the third modified example of the invention. The image forming apparatus in this third modified example, as same in the first embodiment, does not include post-processing apparatus. The image forming apparatus is designed to suck air near the discharge tray 41 by the fan 51 provided in the image forming apparatus main body 10, and to purify the VOC by the active carbon filter 52 and discharge outside.

Different from the first embodiment, the air containing ozone in the image forming apparatus main body 10 and the air containing the VOC in the sheet discharge unit are sucked by the same fan 51 by way of active carbon filter 52, and thereby the VOC is oxidized and decomposed by ozone. Thus, the VOC removal efficiency is enhanced, and the apparatus is simplified and the cost is reduced.

As in this third modified example, by installing the active carbon filter 52 above and near the fixing device 4, the VOC can be removed efficiently by waste heat of the fixing device 4 and activation of molecular motion by heat.

Fourth Modified Example

Figure 7:
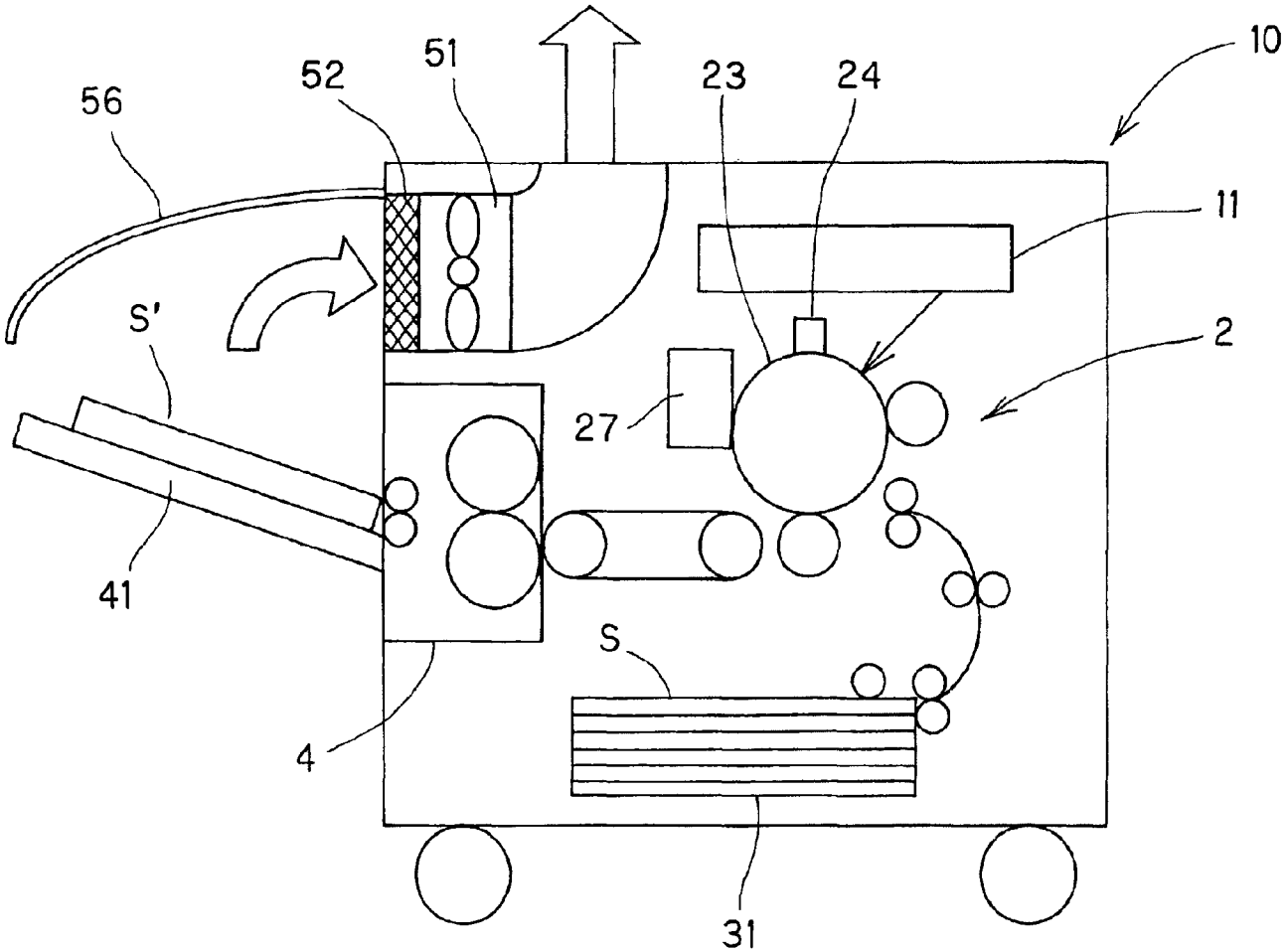
FIG. 7 is a schematic diagram of fourth modified example of the first embodiment.

FIG. 7 shows an image forming apparatus in the fourth modified example of the invention. As shown in FIG. 7, also in this fourth modified example, the VOC is purified and processed and discharged outside as same in the first embodiment. That is, not provided with post-processing apparatus, the image forming apparatus is designed to suck the air near the discharge tray 41 by the fan 51 provided in the image forming apparatus main body 10, and to purify the VOC by the active carbon filter 52 and discharge outside.

In the fourth modified example, a hood 56 is provided as flow straightening means for straightening and sucking efficiently when sucking the atmosphere without diffusing the air containing VOC in the atmosphere of the sheet discharge unit.

Fifth Modified Example

Figure 8:
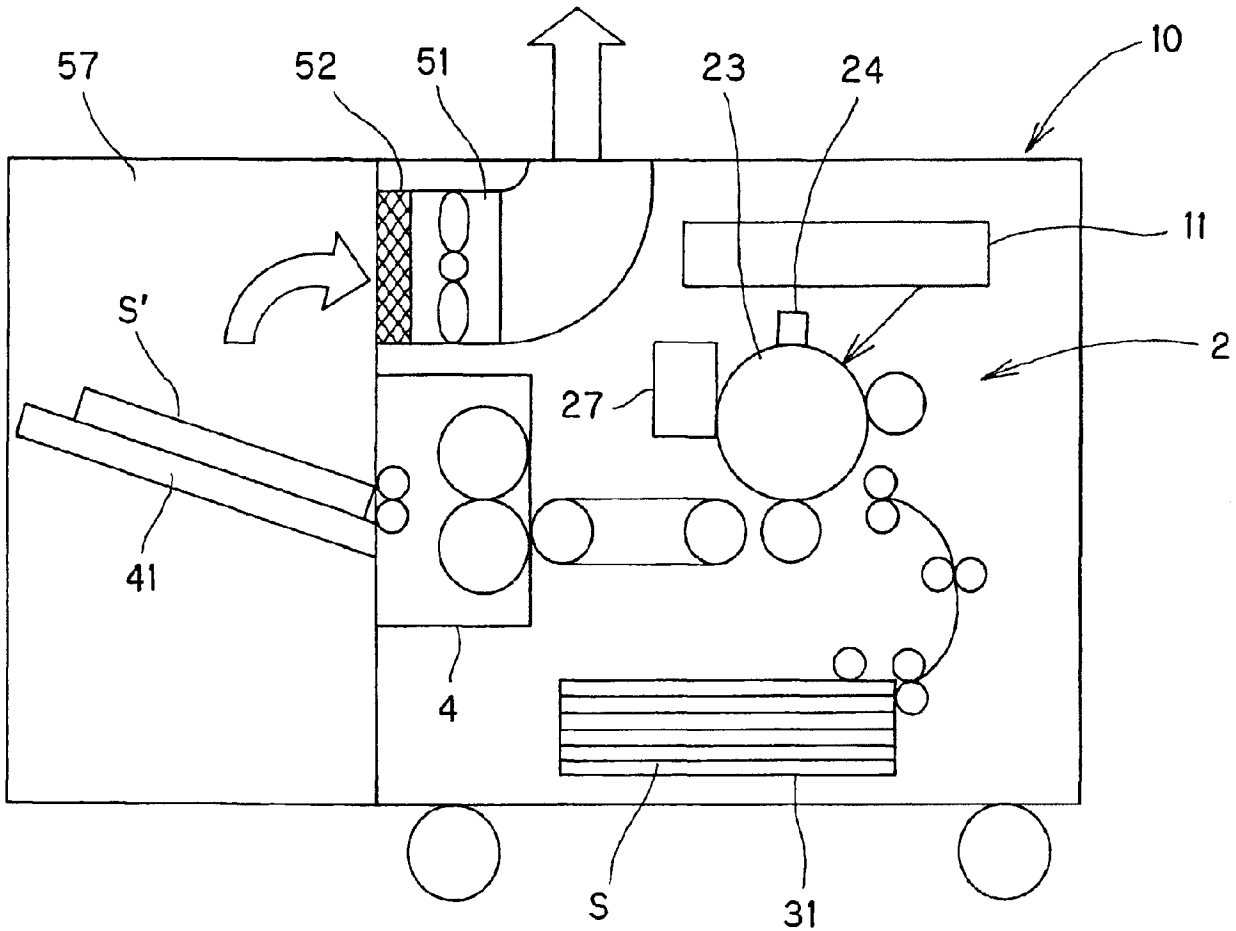
FIG. 8 is a schematic diagram of fifth modified example of the first embodiment.

FIG. 8 shows an image forming apparatus in the fifth modified example of the invention. As shown in FIG. 8, in this fifth modified example, instead of the hood 56 in the fourth modified example, a cover 57 for surrounding the entire discharge tray 41 is provided for sucking efficiently without diffusing the air containing the VOC in the atmosphere of sheet discharge unit, and the sheet discharge unit is closed tightly. To take out the sheet material, a door (not shown) is provided.

Sixth Modified Example

Figure 9:
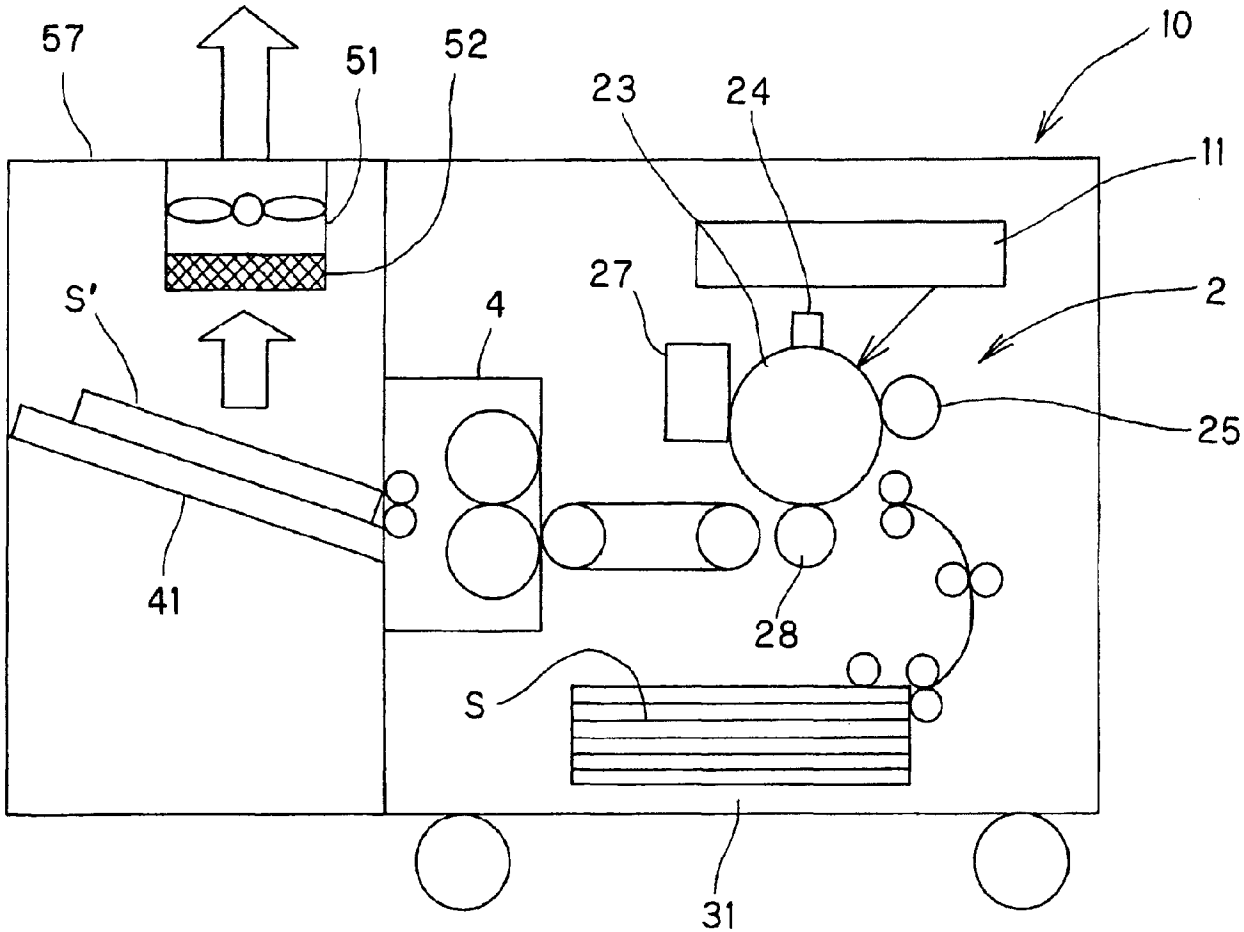
FIG. 9 is a schematic diagram of sixth modified example of the first embodiment.

FIG. 9 shows an image forming apparatus in the sixth modified example of the invention. As shown in FIG. 9, in this sixth modified example, the cover 57 in the fifth modified example is further provided with fan 51 as sucking means and active carbon filter 52 as purifying means.

The embodiment of the invention is thus specifically described below, but the invention is not limited to the foregoing embodiment and its modified examples alone, but may be changed and modified in various forms on the basis of the technical concept of the invention. For example, in the embodiment, active carbon is used in the filter as purifying means, but filter using oxidation catalyst may also be used. Or such filters may be combined. As sucking means, the fan is used, but compressor or other pump may be used instead of fan.

Second Embodiment

Figure 10:
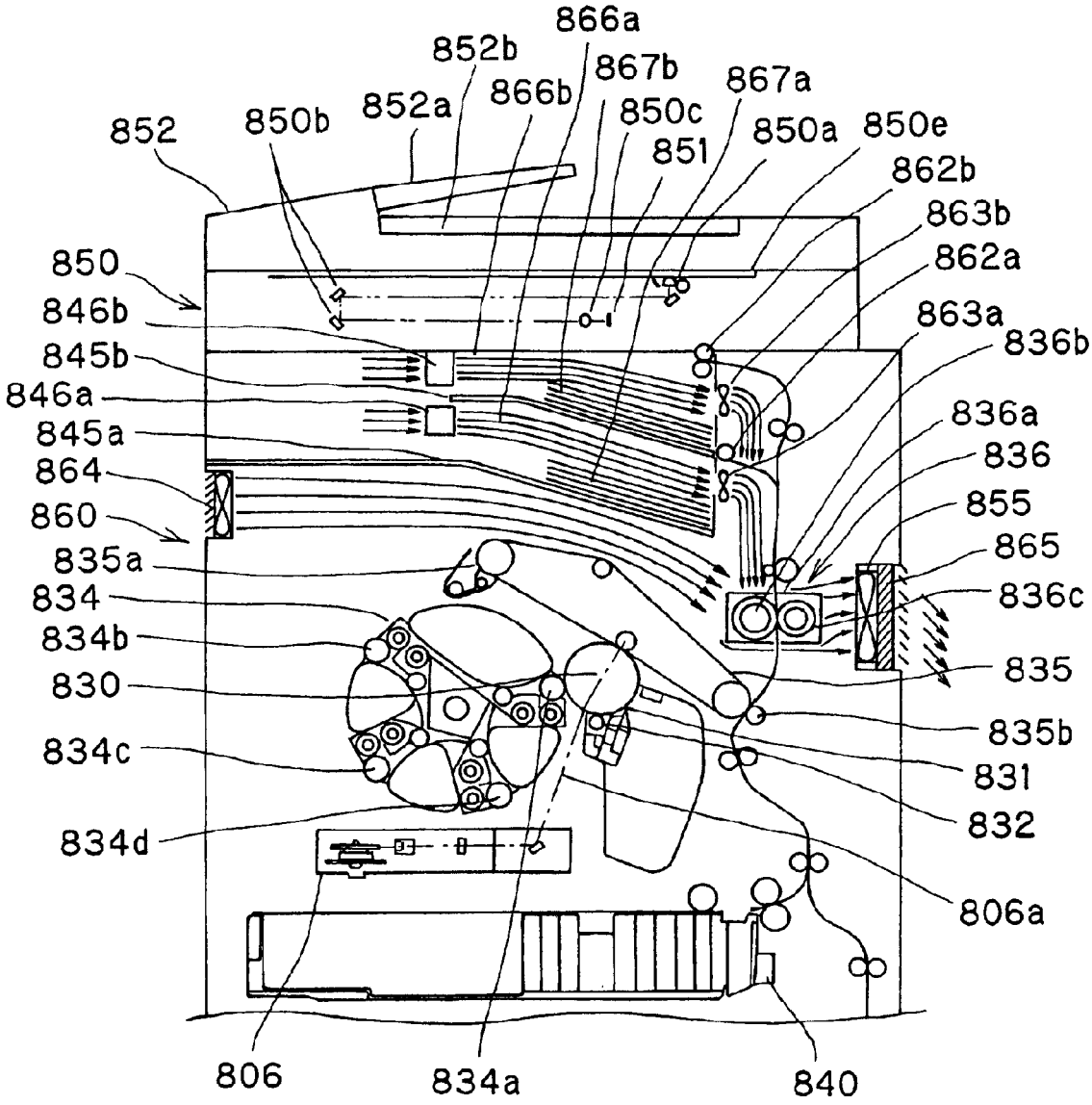
FIG. 10 is a sectional view of primary portions of color copying machine according to the second embodiment.
Figure 11:
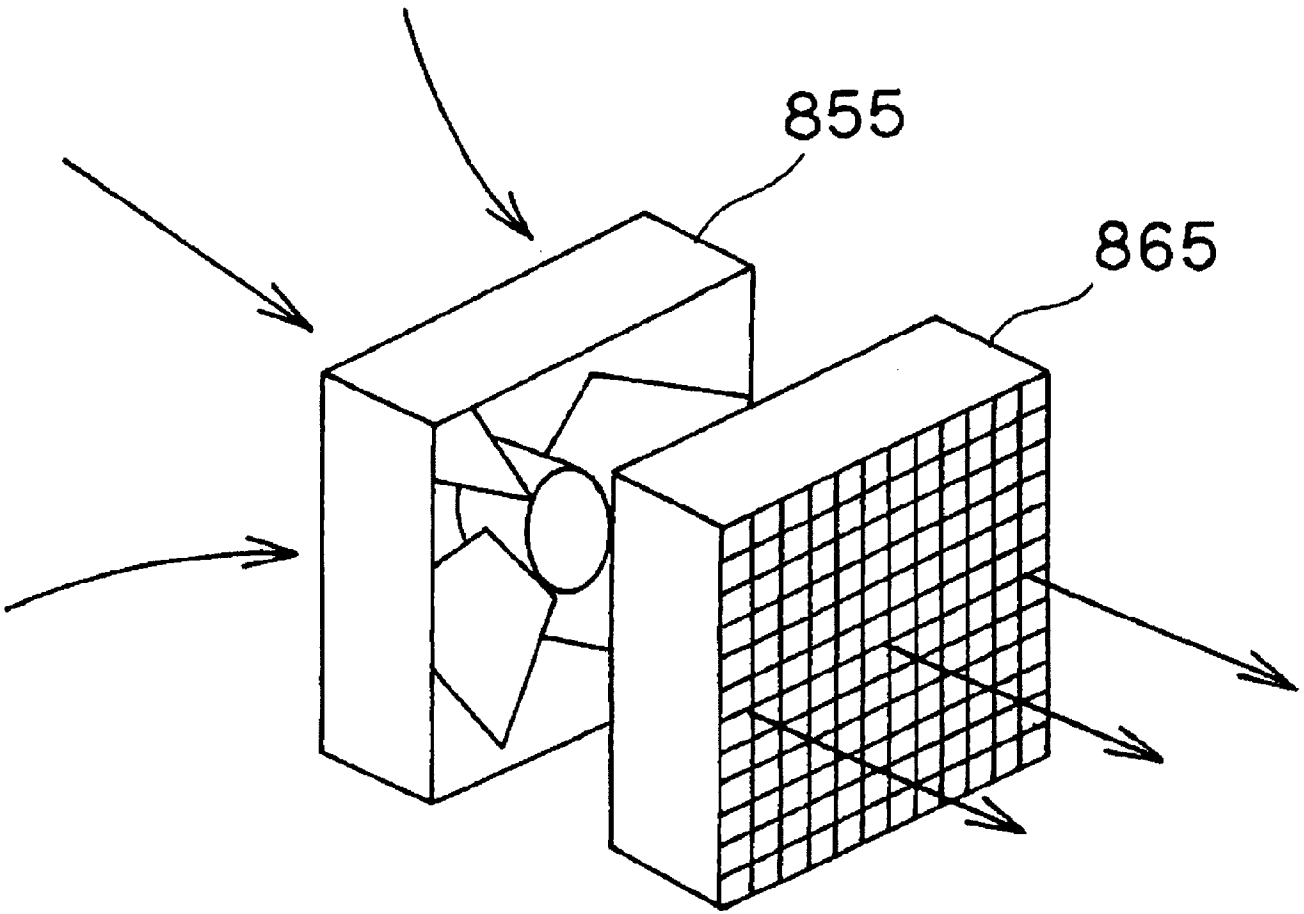
FIG. 11 is a perspective view of filter.

An image forming apparatus according to the second embodiment of the invention is described with referring to FIG. 10 and FIG. 11. The image forming apparatus herein is a color copying machine. FIG. 10 is a sectional view of primary portions of color copying machine according to the second embodiment, and FIG. 11 is a perspective view of filter.

The color copying machine shown in FIG. 10 comprises a document reading unit 850 having a document automatic feeder 852, and a printer unit 860.

The document reading unit 850 reads the document and obtains electronic data, and is composed of first mirror unit 850*a*, second mirror unit 850*b*, lens 850*c*, CCD 851, and platen 850*e*.

The printer unit 860 for printing the obtained electronic data is composed of the following members: sheet feeder 840 and image forming unit above it; heat-fixing device 836 composed of heating roller 836*b*, pressure roller 836*c*, and casing cover 836*a*; first suction fans 863*a*, 863*b* as first suction means for forming air curtains 866*a*, 866*b* in the space above discharge trays 845*a*, 845*b* formed in pair with air feed fans 846*a*, 846*b* as air feed means; second suction fan 864 as second suction means for sucking cooling air from the space outside of apparatus; discharge fan 855 for guiding the air supplied from first suction fans 863*a*, 863*b* and second suction fan into heat-fixing device 836 by way of first duct and third duct composed of ducts not shown, and discharging outside of apparatus; filter 865 as removal means for removing gas components such as VOC gas and dust contained in the sucked air; discharge trays 845*a*, 845*b* as stacking means for stacking up the sheets on which images are formed; and discharge roller pair 862*a*, 862*b* as discharge means for discharging sheets into discharge trays.

The image forming unit further includes a photosensitive drum 830 to be rotated by a drive mechanism not shown. The photosensitive drum 830 is surrounded by a rotary developing section 834 including magenta development unit 834*d*, cyan development unit 834*c*, yellow development unit 834*b*, and black development unit 834*a*. It further includes intermediate transfer belt 835, belt cleaner 835*a*, cleaner 831, charging roller 832, and optical scanning device 806 for emitting laser beam to photosensitive drum 830. An image forming unit is constituted with these members.

Operation of color copying machine having such configuration is explained. The operator for copying the original document by this color copying machine first puts the original on the document tray 852*a*, and starts the operation of color copying machine by pressing the start key not shown provided in the document reading unit 850. The color copying machine starts operation, and sends the document to the top surface of the platen 850*e*, and the entire surface is scanned by the first mirror unit 850*a* moving from left to right in FIG. 1, and the document is discharged into the discharge tray 852*b*. The image scanned by the first mirror unit 850*a* is guided into the CCD 851 by way of second mirror unit 850*b* and lens 850*c*, where the image is converted into electronic data, and sent into the printer unit 860. The printer unit 860 selects necessary color toners among magenta, yellow, cyan and black, on the basis of color information of electronic data, and overlays on the sheet sent from the sheet feeder 840, and forms a color image. Supposing to use all four colors, the transfer process is specifically described below.

The printer unit 860 first rotates the rotary developing section 834, and sets the magenta development unit 834*d* opposite to the photosensitive drum 830. The photosensitive drum 830 and intermediate transfer belt 835 are rotatably driven at constant peripheral, speed by drive source not shown. The photosensitive drum 830 is uniformly charged on the surface by the charging roller 832, and receives laser beam 806*a* from an optical scanning device 806, and forms an electrostatic latent image for magenta color on its surface. This electrostatic latent image is developed as magenta toner image as magenta toner is migrated from the magenta development unit 834*d*, and transferred onto the intermediate transfer belt 835. The magenta toner remained on the photosensitive drum 830, not being transferred to the intermediate transfer belt 835, is cleaned by the cleaner 831.

Thus, after magenta development, the rotary developing section 834 rotates and sets the cyan development unit 834*c* opposite to the photosensitive drum 830. In the same procedure as in the magenta toner image, a cyan toner image is formed on the photosensitive drum 830, and is transferred on the intermediate transfer belt 835 to be overlaid on the magenta toner image. Similarly, the yellow development unit 834*b* and black development unit 834*a* are sequentially set opposite to the photosensitive drum 830, and the color toners are overlaid on the previously transferred toner images, and transferred on the intermediate transfer belt 835.

The four color images of magenta, cyan, yellow, and black thus overlaid and transferred on the intermediate transfer belt 835 are transferred in batch on the sheet sent from the sheet feeder 840 at the transfer unit 835*b*. The toners remained on the intermediate transfer belt 375 after transfer of toner images are scraped off by the belt cleaner 835*a*.

In this manner, after the color image is transferred on the sheet, the printer unit 860 heat-fixes the toner image on the sheet by the heat-fixing device 836. The sheet on which the image is heat-fixed is discharged onto the discharge trays 845*a*, 845*b* by discharge roller pair 862*a*, 862*b*, and the operation is completed.

The color copying machine can reproduce a full color copy by the aforementioned operation, and is packaged in a compact design. The problem in this case is processing of VOC gas generated from the heat-fixing device 836. Since the color copying machine has both printing function and copying function, and is used often by the user, the number of output copies have been increased. As a result, the amount of VOC gas generated from the output sheets 867*a*, 867*b* stacked up on the discharge trays 845*a*, 845*b* may exceed an ignorable level. The VOC gas generated from the output sheets 867*a*, 867*b* (the sheets and the toners transferred on the sheets) reaches the maximum amount right after heating by the heat-fixing device 836. Further, after output on the discharge trays 845*a*, 845*b*, VOC gas is generated continuously until the temperature decreases below a specified point. The amount of VOC gas generated from output sheets 867*a*, 867*b* depends on the number of output copies, and the generation amount increases as the number of output copies increases.

Accordingly, the color copying machine according to the embodiment is designed to remove not only the VOC gas generated from the VOC source such as heat-fixing device 836 inside the apparatus, but also the VOC gas generated from output sheets 867*a*, 867*b* on the discharge trays 845*a*, 845*b*. The VOC gas removing mechanism of the color copying machine according to the embodiment is explained below.

Air feed fans 846*a*, 846*b*, and first suction fans 863*a*, 863*b* continue to operate for a specified time after output sheets 867*a*, 867*b* are discharged on discharge trays 845*a*, 845*b*. The operating time of the fans is the duration until the VOC gas is not generated from the time of output sheets 867*a*, 867*h* becoming less than specified temperature. Specifically, the first suction fans 863*a*, 863*b* continue to operate from the time of start of discharge of sheets onto discharge trays 845*a*, 845*b* until the specified time has passed from the end of discharge.

During operation of air feed fans 846*a*, 846*b*, and first suction fans 863*a*, 863*b*, air curtains 866*a*, 866*b* are formed as airflows above the discharge trays 845*a*, 845*b*. The air curtains 866*a*, 866*b* work to guide the VOC gas generated from the output sheets 867*a*, 867*b* (the gas temperature is higher than room temperature, and the gas rises and is drawn into the air curtain) into the apparatus main body. The air containing the VOC gas is guided to the surrounding of the heat-fixing device 836 and cools the heat-fixing device 836, and sucked into the discharge fan 855 together with the VOC gas generated from the heat-fixing device 836, and the VOC gas is removed by the filter 865. The filter 865 composes a VOC removing unit for removing VOC.

A filter is often used as removing means for removing VOC. FIG. 2 shows a filter 865 as VOC removing means used in image forming apparatus of the embodiment. The filter 865 shown in FIG. 2 is a so-called honeycomb filter, and is a most common type. The honeycomb filter has lots of small through-holes, and while the air passes through the holes, the functional material applied on the hole wall removes VOC gas. The functional material is catalyst, active carbon or other adsorbent for decomposing VOC gas, and the catalyst is long in life, and the adsorbent has a wide range of applicable materials. In this example, active carbon is used as functional material in consideration of wide range of applicable materials (because the VOC gas generated from the fixing device, sheet and toner is composed of multiple components). The honeycomb filter is characterized by low-pressure loss, and is easy to assure airflow rate of discharge fan 855 (that is, easy to cool the heat-fixing device 836), and is hence used widely.

In this embodiment, the filter 865 is used as VOC removing means, but not limited to this, various methods are possible and selected depending on the feature of each method. For example, aside from the filter, the VOC removing means may be realized by photocatalyst device, ozone cleaning device, and other various means. The photocatalyst device decomposes the VOC gas by photocatalyst which is activated by irradiation with ultraviolet ray, and is not so high in removing performance, but is longer in life as compared with the filter. The ozone cleaning device is to decompose VOC gas by oxidation action of ozone generated from discharge device, and is long in life as same in a photocatalyst device.

Operation of first suction fans 863*a*, 863*b* is limited to a specified time as stated above, which is because the air temperature around discharge trays 845*a*, 845*b* is higher than room temperature, and therefore it is not suited to cooling of heat-fixing device 836. It is also because the air curtains 866*a*, 866*a*, if maintained all the time, may have effects on moisture content of output sheets 867*a*, 867*b*, possibly having adverse effects such as curling of sheet. Accordingly, the color copying machine of the invention has the second suction fan 864 for sucking air from outside of the apparatus. The air sucked by the second suction fan 864 is guided into the heat-fixing device 836, and cools the heat-fixing device 836. The second suction fan 864 is put in operation when the temperature of the casing cover 836*a* of the heat-fixing device 836 exceeds a predetermined temperature, and compensates for shortage of cooling effect by the first suction fans 863*a*, 863*b*. The temperature of the casing cover 836*a* of the heat-fixing device 836 may be measured by installing sensor or other temperature detecting means, or by predicting from the operation time of the heat-fixing device 836.

Thus, according to the embodiment, air is sucked in from the surrounding space of output sheets 867*a*, 867*b* on the discharge trays 845*a*, 845*b*, and the air is guided into the filter 865 for removing VOC gas and dust. Therefore, if VOC gas is generated from the output sheets 867*a*, 867*b* on the discharge trays 845*a*, 845*b*, the VOC gas can be collected by the first suction fans 863*a*, 863*b*, and can be removed securely.

The first suction fans 863*a*, 863*b* operate only for a specified time after discharge of output sheets 867*a*, 867*b* until the output sheets 867*a*, 867*b* are cooled to a temperature low enough not to dissipate VOC gas. Accordingly, the output sheets 867*a*, 867*b* are not cooled and dried excessively to cause curling or other adverse effects.

The air sucked by the first suction fans 863*a*, 863*b* passes through the surrounding space of the heat-fixing device 836, and hence the VOC gas generated from the heat-fixing device 836 can also be removed securely.

Aside from the first suction fans 863*a*, 863*b* for sucking the air in the surrounding space of output sheets 867*a*, 867*b* on discharge trays 845*a*, 845*b*, the second suction fan 864 is provided for sucking air outside of the apparatus. Accordingly, a flow rate of air enough to cool the heat-fixing device 836 can be assured.

The second suction fan 864 is put in operation when the temperature of the heat-fixing device 836 exceeds a predetermined temperature, and compensates for shortage of cooling effect by the first suction fans 863*a*, 863*b*, and can cool the heat-fixing device 836 securely.

By forming air curtains 866*a*, 866*b* on the discharge trays 845*a*, 845*b*, the VOC gas generated from the output sheets 867*a*, 867*b* on the discharge trays 845*a*, 845*b* can be captured efficiently.

In this embodiment, the air curtains 866*a*, 866*b* are formed by combination of air feed fans 846*a*, 846*b* and first suction fans 863*a*, 863*b*, but the configuration is not limited to this example alone. For example, without using air feed fans 846*a*, 846*b*, the airflow may be generated in the space above the discharge trays 845*a*, 845*b* by the first suction fans 863*a*, 863*b* only. By eliminating the air feed fans 846*a*, 846*b*, the operation noise is reduced, and it is effective if the discharge trays are projecting to the outer side of the apparatus.

In the embodiment, the first suction fans 863*a*, 863*b* are provided in the lower one part of discharge roller pair 862*a*, 862*b*, but the configuration is not limited to this example. For example, by eliminating the suction fans in the lower one part of the discharge roller pair, only suction parts may be provided at the positions of the suction fans. In this case, discharge fan is used as first suction means for sucking the air from the surrounding space of output sheets 867*a*, 867*b* on discharge trays 845*a*, 845*b*. Thus without using the suction fans 863*a*, 863*b*, the operation noise is reduced, and by reinforcing the discharge fan 855, the air curtains 866*a*, 866*b* may be maintained sufficiently.

In the above embodiment, the air sucked by the first suction fans 863*a*, 863*b* is guided into the filter 865 by way of the surrounding space of the heat-fixing device 836, and a air passage by duct not shown is exemplified. The air passage includes the first air passage for guiding the air sucked from the first suction fans 863*a*, 863*b* into the heat-fixing device 836, and the second air passage for guiding the air passing through the heat-fixing device 836 into the filter 865, but the invention is not limited only to these configurations. Not limited to ducts, for example, an air passage may be formed by forming ribs in the apparatus, or constituent parts may be arranged in the apparatus to form an air passage. When the path is nearly straight from the discharge trays 845*a*, 845*b* to the filter 865 by way of the heat-fixing device 836, the sucked air can be guided into the filter 865 without forming ducts or air passages.

Third Embodiment

Figure 12:
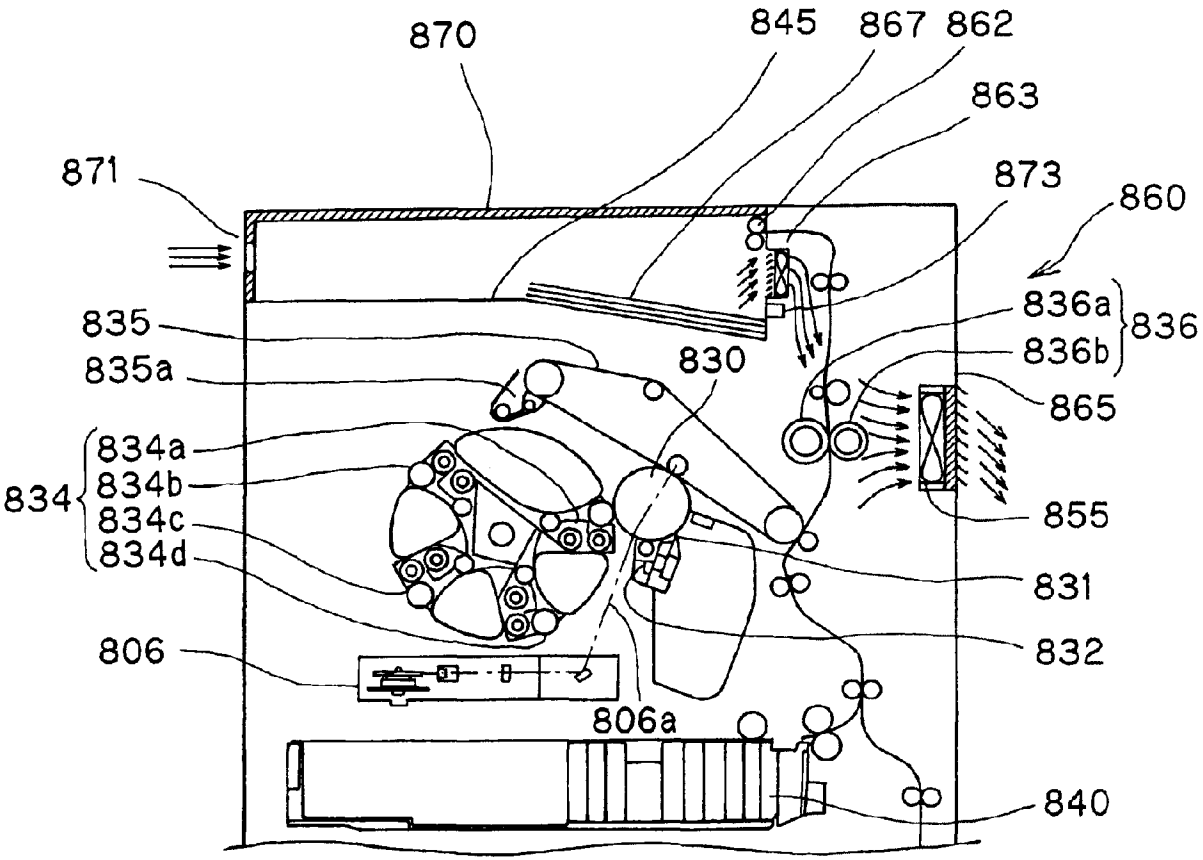
FIG. 12 is a sectional view of primary portions of color printer according to the second embodiment.

Referring now to FIG. 12 and FIG. 13, an image forming apparatus according to the third embodiment is explained. Here, the image forming apparatus is exemplified by a color printer. FIG. 12 is a sectional view of primary portions of color printer according to the third embodiment, and FIG. 13 is a perspective view of the printer. In the drawings, the same reference numerals indicate same or similar components.

The printer shown in FIG. 12 is a printer unit 860, which comprise a sheet feeder 840 and an image forming unit disposed in the upper part A heat-fixing device 836 is composed of heating roller 836*a* and pressure roller 836*b*. It further comprises a discharge tray 845 as stacking means for stacking up the sheets on which images are formed, and discharge roller pair 862 as discharge means for discharging sheets into the discharge tray 845.

The printer unit 860 includes a cover 870 as a freely opening and closing cover member disposed so as to cover the discharge tray 845, and the first suction fan 863 as first suction means for sucking the air from the space above the discharge tray 845. It also includes a discharge fan 855 for guiding the air supplied from the suction fan 863 into the heat-fixing device 836 by way of the first air passage composed of duct not shown, and discharging outside of the apparatus, and a filter 865 for removing VOC gas contained in the air.

The image forming unit has a photosensitive drum 830 which can be rotated by a drive mechanism not shown. The photosensitive drum 830 is surrounded by a rotary developing section incorporating magenta development unit 834*d*, cyan development unit 834*c*, yellow development unit 834*h*, and black development unit 834*a*. It further includes intermediate transfer belt 835, belt cleaner 835*a*, cleaner 831, charging roller 832, and optical scanning device 806 for emitting laser beam to photosensitive drum 830. These members are combined to constitute an image forming unit.

Operation of color printer having such configuration is explained. The printer 860 selects necessary color toners from magenta, yellow, cyan and black, on the basis of color information of electronic data, and transfers on the sheet sent from the sheet feeder 840, and forms a color image. Supposing to use all four colors, the transfer process is specifically described below.

The printer 860 first rotates the rotary developing section 834, and sets the magenta development unit 834*d* opposite to the photosensitive drum 830. The photosensitive drum 830 and intermediate transfer belt 835 are rotatably driven at constant peripheral speed by drive source not shown. The photosensitive drum 830 is uniformly charged on the surface by the charging roller 832, and receives laser beam 806*a* from an optical scanning device 806, and forms an electrostatic latent image for magenta color on its surface. This electrostatic latent image is developed as magenta toner image as magenta toner is migrated from the magenta development unit 834*d*, and transferred onto the intermediate transfer belt 835. The magenta toner remained on the photosensitive drum 830, not being transferred to the intermediate transfer belt 835, is cleaned by the cleaner 831.

Thus, after completion of magenta development, the rotary developing section 834 rotates and sets the cyan development unit 834*c* opposite to the photosensitive drum 830. In the same procedure as in the magenta toner image, a cyan toner image is formed on the photosensitive drum 830, and is transferred on the intermediate transfer belt 835 to be overlaid on the magenta toner image. Similarly, the yellow development unit 834*b* and black development unit 834*a* are sequentially set opposite to the photosensitive drum 830, and the respective color toners are overlaid on the existing toner images, and transferred on the intermediate transfer belt 835.

The four color images of magenta, cyan, yellow, and black thus overlaid and transferred on the intermediate transfer belt 835 are transferred in batch on the sheet sent from the sheet feeder 840 at the transfer unit 835*b*. The toners remained on the intermediate transfer belt 835 after transfer of toner images are scraped off by the belt cleaner 835*a*.

In this manner, after the color image is transferred on the sheet, the printer 860 heat-fixes the toner image on the sheet by the heat-fixing device 836. The sheet on which, the image is heat-fixed is discharged onto the discharge tray 845 by discharge roller pair 862, and the operation is completed.

The color printer herein has a problem of processing of VOC gas generated from the heat-fixing device 836. Besides, since the color printer is used often by the user, if the number of output copies is very large, and as a result, the amount of VOC gas generated from the output sheets 867 stacked up on the discharge tray 845 may also exceed an ignorable level. The VOC gas generated from the output sheets (the sheets and the toners transferred on the sheets) reaches the maximum Amount right after heating by the heat-fixing device 836. Further, after output onto the discharge tray 845, VOC gas is generated continuously until the temperature decreases below a specified point. The amount of VOC gas generated from output sheets depends on the number of output copies, and the generation amount increases as the number of output copies increases.

Accordingly, the color printer of the embodiment is designed to remove not only the VOC gas generated from the VOC source such as heat-fixing device 836 in the apparatus, but also the VOC gas generated from output sheets 867 on the discharge tray 845. The VOC gas removing mechanism of the color printer of the embodiment is explained below.

A cover 870 covering the space above the discharge tray 845 including the upper one part of the discharge tray 845 has an air suction port 871, and by the operation of the suction fan 863, the external air is guided into a nearly closed space formed in the cover 870. The size of air suction port 871 is not specified, and may be, for example, a gap between the cover and the casing of the apparatus main body. Not limited too suction port, the second suction fan (second suction means) of the second embodiment may be provided.

In the nearly closed space formed by the cover 870, a temperature sensor 873 is provided as temperature detecting means near the stacking position of output sheet 867, and the temperature near the output sheet 867 is detected.

The suction fan 863 continues to operate for a specified time after discharge of output sheet 867. The operating time of the fan is the duration until VOC gas is not generated from the time of the output sheet 867 becomes lower than specified temperature. In this embodiment, the operation time of the fan is determined appropriately depending on the temperature detecting signal from the temperature sensor 873 and the type of paper of output sheet.

The VOC gas generated from the output sheet 867 is guided into the apparatus main body. The air containing the VOC gas passes through the first air passage of duct not shown, and is guided into the surrounding of the heat-fixing device 836, and cools the heat-fixing device 836. Further, the air passes through the second air passage of duct not shown, and is sucked into a fixing fan 855 together with the VOC gas generated from the heat-fixing device 836, and the VOC gas is removed by the filter 865.

In the embodiment, a filter 865 is used as VOC removing means for removing VOC gas contained in the sucked air. This filter 865 is a so-called honeycomb filter, and is a most common type (see FIG. 2). The honeycomb filter has lots of small through-holes, and while the air passes through the holes, the functional material applied on the hole wall removes VOC gas. The functional material is catalyst, active carbon or other adsorbent for decomposing VOC gas, and the catalyst is long in life, and the adsorbent is wide in a range of applicable materials. In this example, active carbon is used as functional material in consideration of wide range of applicable materials (because the VOC gas generated from the fixing device, sheet and toner is composed of multiple components). The honeycomb filter is characterized by low-pressure loss, and is easy to assure airflow rate of discharge fan 855, and is hence used widely.

In this embodiment, the filter 865 is used as VOC removing means, but not limited to this, various methods are possible and selected depending on the feature of each method. Aside from the filter, the VOC removing means may be realized by photocatalyst device, ozone cleaning device, and various means. The photocatalyst device decomposes the VOC as by photocatalyst which is activated by irradiation with ultraviolet ray, and is not so high in removing performance, but is longer in life as compared with the filter. The ozone cleaning device is to decompose VOC gas by oxidation action of ozone generated from discharge device, and is long in life as same photocatalyst device. These VOC removing means may be used instead of the filter 865.

Figure 13A:
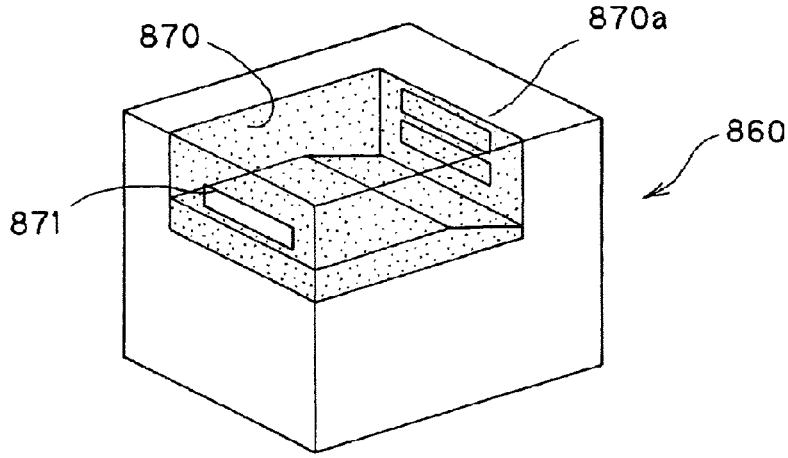
FIG. 13A is a perspective view showing a closed state of cover of color printer according to the second embodiment.

The structure of the cover 870 for covering the surrounding space of sheet on discharge tray 845 is explained with referring to FIG. 13. FIG. 13A is a perspective schematic view of color printer showing a closed state of cover 870. The cover 870 for covering the space above the discharge tray 845 is formed of a translucent resin or the like, and the output sheet 867 discharge onto the internal discharge trey 845 may be visible. The cover 870 covers the surrounding space including the discharge tray 845 in a nearly closed state.

Figure 13B:
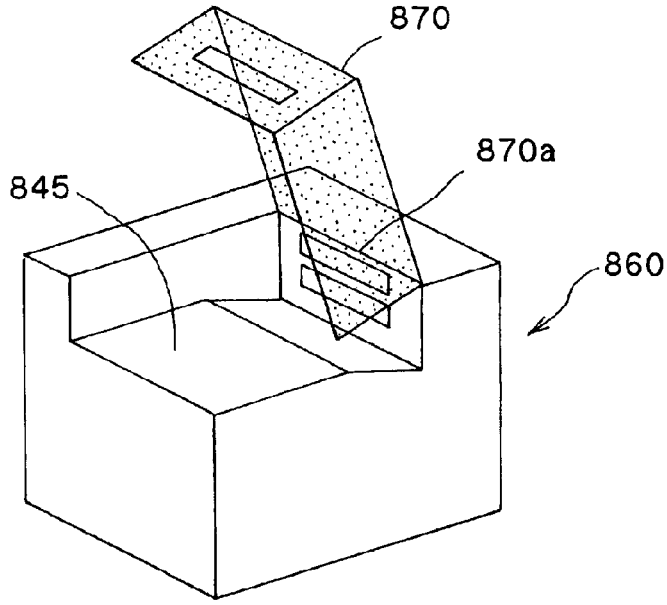
FIG. 13B is a perspective view showing an opened state of cover of color printer according to the second embodiment.

FIG. 13B is a perspective schematic view of color printer showing an opened state of cover 870. The cover 870 disposed rotatably on the printer unit 860 about a hinge 870*a*, and the cover 870 can be opened and closed freely. After VOC gas is removed, the output sheet 867 is taken out by opening the cover 870.

As described above, according to the embodiment, the surrounding space of output sheet 867 on discharge tray 845 is nearly closed by cover 870, and the air in the space is sucked by the suction fan 863, and is guided into the filter 865. Therefore, if VOC gas is generated from the output sheet 867 on the discharge tray 845, this VOC gas is nearly closed by the cover 870 and is prevented from dissipating, and is collected by the first suction fan 863, and can be removed securely by the filter 865.

After discharge of output sheet 867, the suction fan 863 operates only for a predetermined time until the temperature of output sheet 867 is cooled low enough not to dissipate VOC gas. It is hence free from curling or adverse effects due to excessive cooling or drying of output sheet 867.

The air sucked by the suction fan 863 passes through the surrounding space of the heat-fixing device 836, and hence securely removes the VOC gas generated from the heat-fixing device 836.

Since the space above the discharge tray 845 is covered with the cover 870 and is nearly closed, the VOC gas generated from the output sheet 867 on the discharge tray 845 can be captured efficiently.

As same in the second embodiment, aside from the first suction fan 863 for sucking the air in the surrounding space of the output sheet 867 on the discharge tray 845, the second suction fan (second suction means) may be provided for sucking the air outside of the apparatus. According to this configuration, enough flow rate of air for cooling the heat-fixing device 836 is assured. The second suction fan is put in operation when the temperature of the heat-fixing device 836 exceeds a predetermined temperature, and compensates for shortage of cooling effect by the first suction fan 863, so that the heat-fixing device 836 can be cooled securely.

Fourth Embodiment

Figure 14:
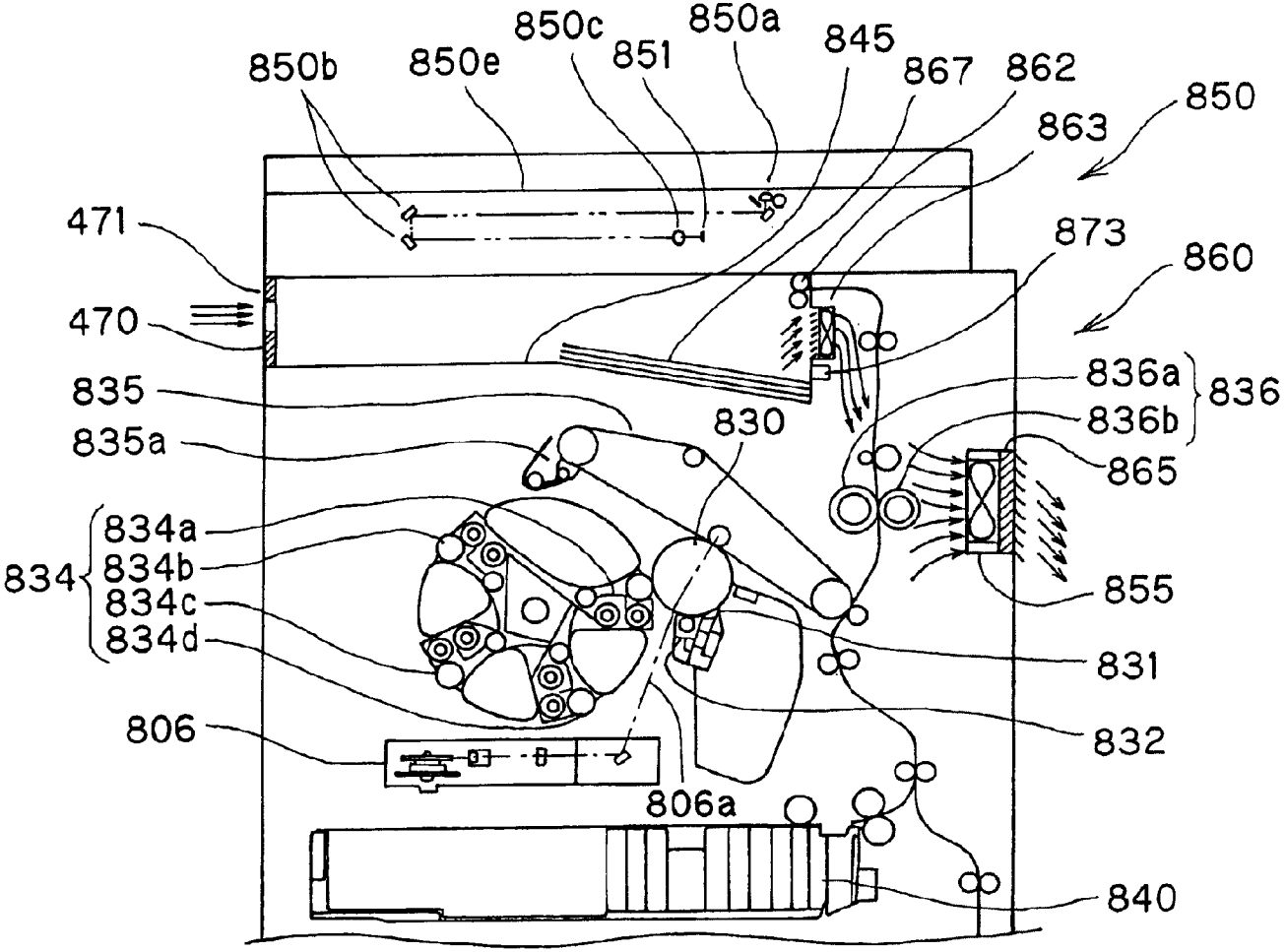
FIG. 14 is a sectional view of primary portions of color copying machine according to the third embodiment.

Referring to FIG. 14 and FIG. 15, an image forming apparatus according to the fourth embodiment is described. This image forming apparatus is a color copying machine. FIG. 14 is a sectional view of primary portions of color copying machine according to the fourth embodiment, and FIG. 15 is a perspective view of the copying machine. In the drawings, same reference numerals show same or similar parts and duplicate explanation of them is omitted.

The color copying machine shown in FIG. 14 comprises a document reading unit 850 having an automatic document feeder 852, and a printer unit 860. The structure and operation of the printer unit 850 are as same in the third embodiment, and the explanation is omitted.

The document reading unit 850 obtains electronic data by reading the document, and is composed of the first mirror unit 850*a*, the second mirror unit 850*b*, a lens 850*c*, a CCD 851, and a platen 850*e*.

Operation of document reading unit 850 is as follows. The user for copying the original by the color copying machine first places the original on the top of the platen 850*e*, and presses the start key not shown provided in the document reading unit 850 to put the color copying machine in operation. The color copying machine starts its operation, and scans the entire surface of the top of the platen 850*e* by the first mirror unit 850*a* moving from left to right in FIG. 3. The image scanned by the first mirror unit 850*a* is guided into the CCD 851 by way of the second mirror unit 850*b* and lens 850*c* where the image is converted into electronic data and sent into the printer unit 860.

A characteristic portion of the embodiment is explained with referring to FIG. 15. The copying machine as the image forming apparatus of the embodiment has the upper one part of the discharge tray 845 covered with one part of the copying machine main body (the lower side of the document reading unit 850). To cover the peripheral space of the sheet 867 on the discharge tray 845, a cover 470 is provided as cover member for covering the lateral surface portion of the discharge tray 845. To take out the output sheets 867 stacked up on the discharge tray 845, a part 470*b* (or whole) of the cover 470 is provided in the copying machine main body so as to be free to be opened and closed.

Figure 15A:
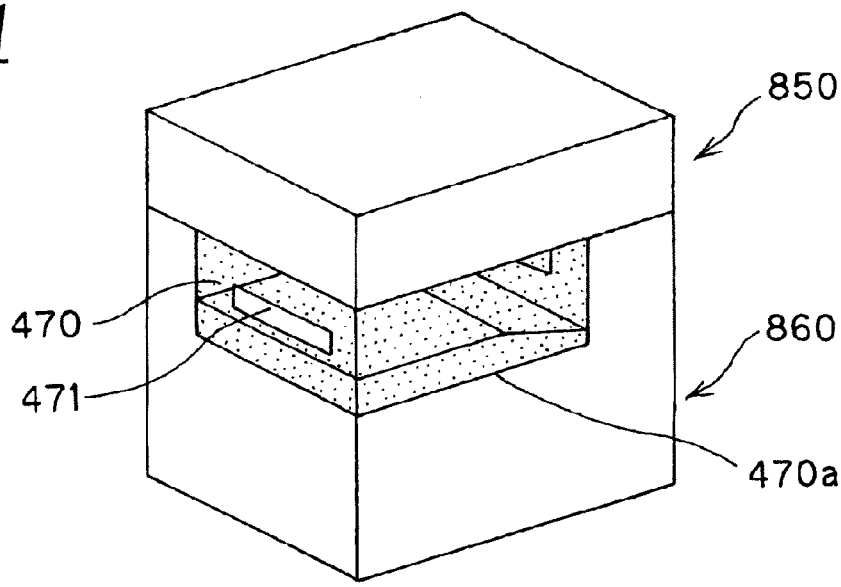
FIG. 15A is a perspective view showing a closed state of cover of color copying machine according to the third embodiment.

FIG. 15A is a perspective schematic view of color copying machine showing a closed state of the cover 470. In the embodiment, since the document reading unit 850 is disposed on the top of the discharge tray 845, the cover 470 covers the lateral surface portion of the discharge tray 845. The cover 470 is formed of a translucent resin so that the output sheet 867 discharged onto the internal discharge tray 845 may be visible. The cover 470 covers the surrounding space including the discharge tray 845 in a nearly closed state.

Figure 15B:
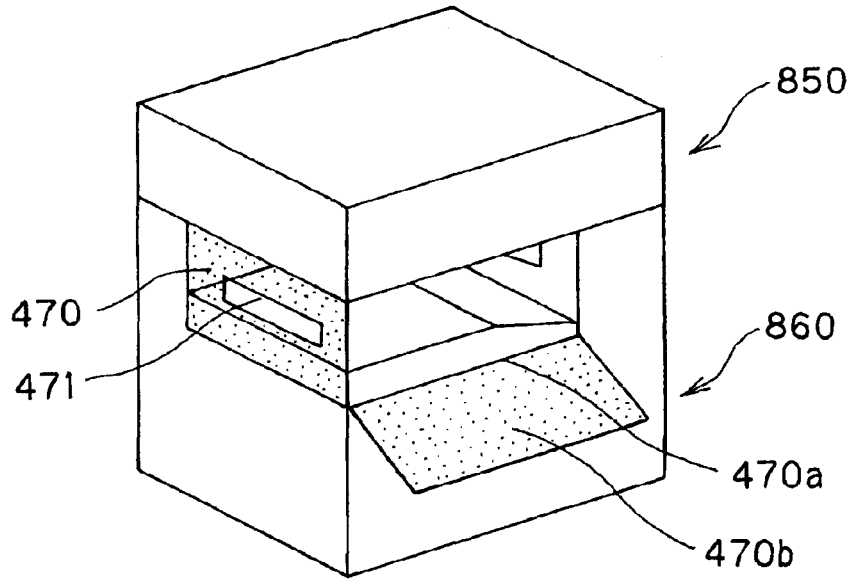
FIG. 15B is a schematic perspective view showing an opened state of cover of color copying machine according to the third embodiment.

FIG. 15B is a perspective schematic view of color copying machine showing an opened state of part 470*b* of the cover 470. The cover 470*b* is composed rotatably on the copying machine main body on the center of hinge 470*a*, and the cover 870 is free to open and close. After removal of VOC gas, the output sheet 867 is taken out by opening the cover 470*b*.

In this configuration, in the embodiment, same effects as in the second embodiment are obtained.

In the embodiment, part 470*b* of the cover 470, which can be freely opened and closed, is provided in the copying machine main body, but the invention is not limited to this example alone, and the all cover members, which can be freely opened and closed, may be provided detachably in the copying machine main body.

Fifth Embodiment

Referring to FIG. 16, an image forming apparatus according to the fifth embodiment is described. This image forming apparatus is a color copying machine. FIG. 16 is a perspective view of color copying machine according to the fifth embodiment. In the drawings, same reference numerals show same or similar parts and duplicate explanation of them is appropriately omitted.

The color copying machine of the embodiment is similar to the fourth embodiment in its schematic configuration, and only a characteristic portion is explained with referring to FIG. 7.

The copying machine as the image forming apparatus of the embodiment has the upper one part of the discharge tray 545 covered with one part of the copying machine main body (the lower side of the document reading unit 850). To cover the peripheral space of the sheet 867 on the discharge tray 845, a cover 570 is provided as cover member so as to cover the lateral surface portion of the discharge tray 545. The cover 570 is provided integrally with the discharge tray 545. To take out the output sheets 867 stacked up on the discharge tray 545, the discharge tray 545 integrally provided with the cover 570 is drawn out and accommodated in the copying machine main body.

Figure 16A:
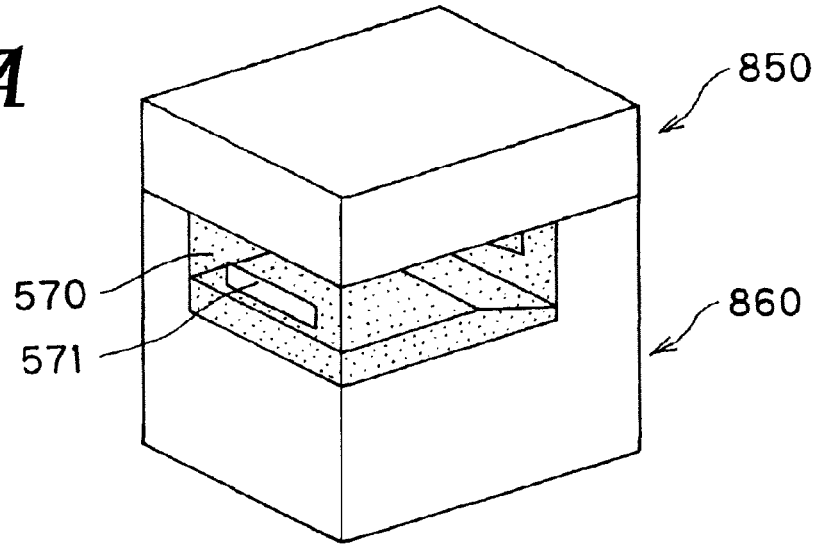
FIG. 16A is a perspective view showing a closed state of cover of color copying machine according to the fourth embodiment.

FIG. 16A is a perspective schematic view of color copying machine showing a closed state of the cover 570. In the embodiment, as compared with the third embodiment, the discharge tray 545 is formed integrally with the cover 570, and is drawn out from the copying machine main body, and the output sheet 867 is taken out.

Figure 16B:
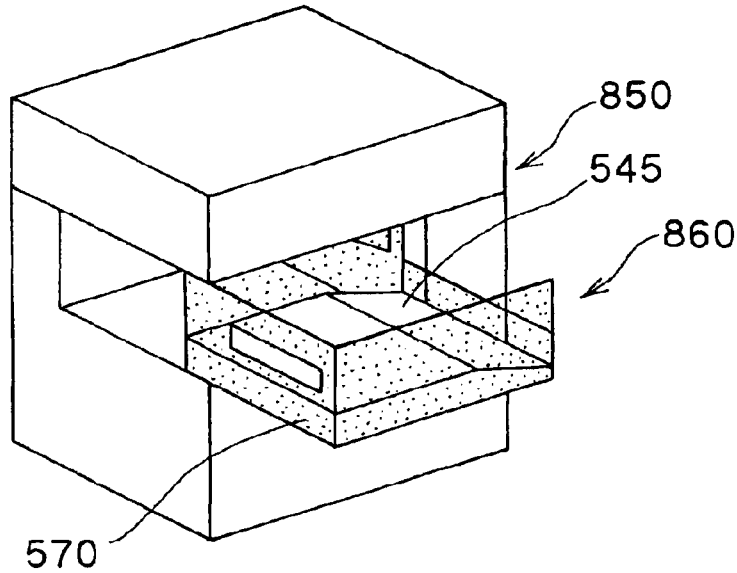
FIG. 16B is a schematic perspective view showing an opened state of cover of color copying machine according to the fourth embodiment.

FIG. 16B is a perspective schematic view of color copying machine showing a state of drawing out the discharge tray 545 including the cover 570. The discharge tray 545 is formed integrally with the cover 570, and is disposed in the copying machine main body so as to be drawn out freely to the front surface. After removal of VOC gas, the output sheet 867 is taken out by drawing out the discharge tray 545 integrated with the cover 570.

In the above-described configuration, according to the embodiment, same effects as in the third and fourth embodiments are obtained, and in addition the following effects are also obtained.

That is, according to the embodiment, if the discharge tray 545 is disposed between the document reading unit 850 and printer unit 860, the output sheet on the discharge tray 545 can be taken out by drawing out the discharge tray 545, and the convenience of operation is improved.

The output sheet can be taken out from above the drawn discharge tray, and as compared with the case of drawing out the sheet from among the units 850, 860, the output sheet is not folded or creased by contacting with the lateral surface of the apparatus.

Sixth Embodiment

Figure 17A:
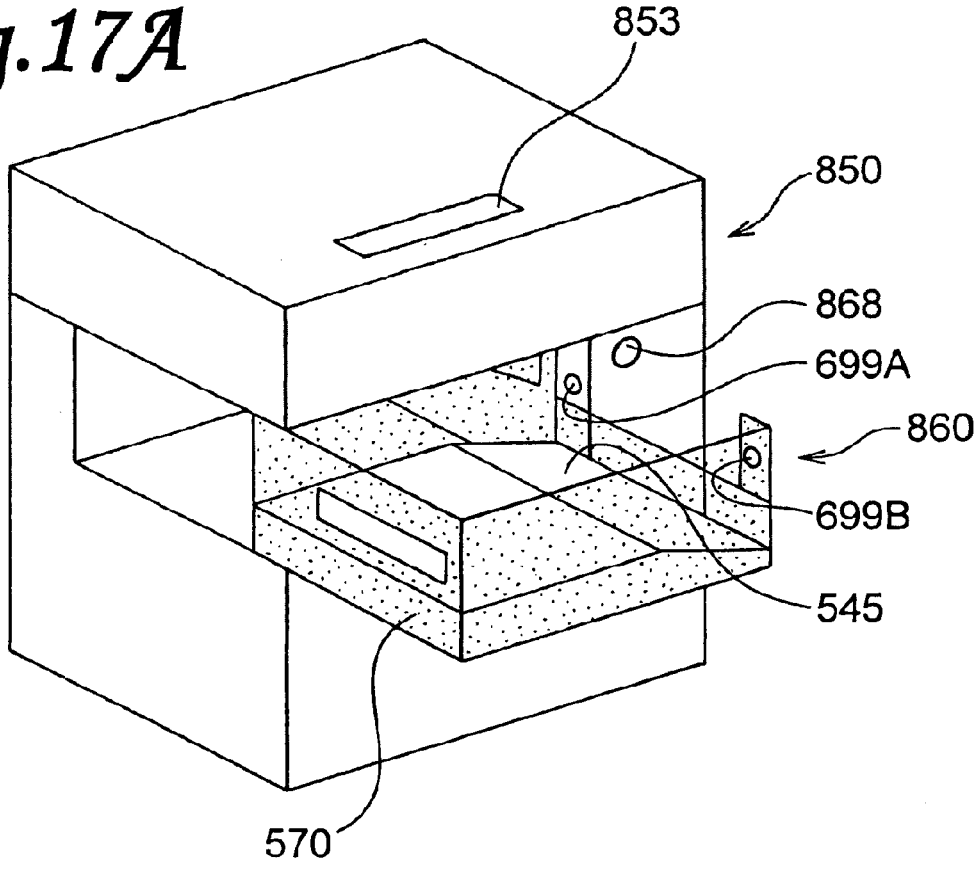
FIG. 17A is a schematic perspective view of color copying machine according to the fifth embodiment.
Figure 17B:
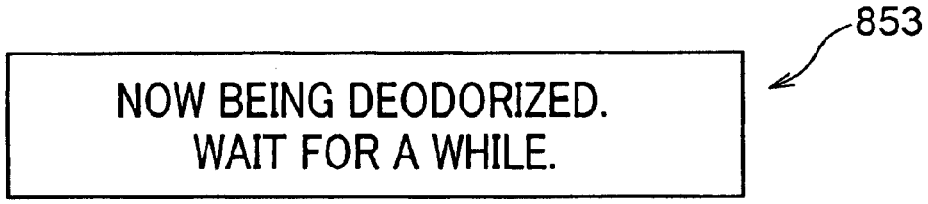
FIG. 17B is a diagram of an example of display state of display unit in operation unit of color copying machine according to the fifth embodiment.

Referring to FIG. 17, an image forming apparatus according to the sixth embodiment is described. This image forming apparatus is a color copying machine. FIG. 17A is a perspective view of color copying machine according to the sixth embodiment, and FIG. 17B shows an example of display state of display unit of the color copying machine. In the drawings, same reference numerals show same or similar parts and duplicate explanation of them is appropriately omitted.

The color copying machine of the embodiment is substantially similar to the fifth embodiment in schematic configuration of configuration, and only a characteristic portion is explained with referring to FIG. 17.

The color copying machine of the embodiment has a locking mechanism as lock means operating to prevent the cover 570 from being opened from the start to the end of operation of suction fan 863. The locking mechanism is composed of a free projecting pin 699A provided in the color copying machine main body, and a hole 6995 formed in the cover 570 in which the pin 699A is fitted. That is, after stopping of the suction fan 893, the pin 699A is drawn out from the hole 699B, and the lock is cleared, and the cover 570 can be drawn out from the color copying machine main body. A display means 853 is provided as display means showing the cover 570 is in a closed state during the time of operation of locking mechanism.

FIG. 17A is a perspective schematic view of color copying machine showing a state of drawing out the discharge tray 545 including the cover 570. This embodiment shows the locking mechanism provided to prevent drawing of the discharge tray 545 integrally provided with the cover 570 explained in the fifth embodiment. Reference numeral 68 in FIG. 17A is unlocking means (unlocking button) for unlocking the locking mechanism. The suction fan 867 continues to operate until the output sheet 867 stacked up on the discharge tray 545 becomes lower than the specified temperature and VOC gas is no longer generated. During operation of the suction fan 863, the discharge tray 545 is prevented front being drawn out by locking mechanism not shown.

Simultaneously, as shown in FIG. 17B, the display unit 853 of the operation unit on the document reading unit 850 such as state of removing VOC gas. Operation of suction fan 863 is stopped when it is judged that the VOC gas is removed by the temperature detecting signal from the temperature sensor 873 (see FIG. 14) or the type of paper of output sheet, and the locking mechanism is unlocked. When taking out the output sheet, the unlocking button 868 is pressed, so that the discharge tray 845 is drawn out automatically.

In this configuration, according to the embodiment, same effects as in the fifth embodiment are obtained, and additionally, the following effects are also obtained.

That is, according to the embodiment, the output sheet can be taken out after completely removing VOC gas generated from the output sheet.

If the output sheet cannot be taken out, it is warned by the display unit in the operation unit, so that the user can understand the situation.

This application claims priority from Japanese Patent Application No. 2006-53260 filed Feb. 28, 2006, and Japanese Patent Application No. 2006-85851 filed Mar. 27, 2006, which is hereby incorporated by reference, herein.

What is claimed is:

1. An image forming apparatus comprising:

an image forming apparatus main body that contains an image forming unit which forms an image on a sheet;

a discharge port, provided on the image forming apparatus main body, through which the sheet is discharged;

a suction device, provided on the image forming apparatus main body, which sucks air;

an opening, formed on a side surface of the image forming apparatus main body through which the air to be sucked by the suction device passes, the opening being provided separately from the discharge port;

a post-processing apparatus, connected to the image forming apparatus main body, which receives the sheet discharged from the image forming apparatus main body through the discharge port, to thereby apply a post-processing operation to the sheet;

a discharge tray, provided on the post-processing apparatus, on which discharged sheets are stacked; and an air passage, provided in the post-processing apparatus, which communicates between the space above the discharge tray and the opening, wherein the suction device sucks the air from the space above the discharge tray into the image forming apparatus main body through the air passage and the opening, and a VOC removing unit, provided on the image forming apparatus main body, which removes VOC contained in the air sucked by the suction device.

2. The image forming apparatus according to claim 1, wherein the opening is provided above the discharge port.

3. The image forming apparatus according to claim 1, wherein the VOC removing unit is provided between the opening and the suction device.

4. The image forming apparatus according to claim 1, further comprising a duct through which air, which has been sucked by the suction device through the opening, passes.

5. The image forming apparatus according to claim 4, wherein the VOC removing unit is provided in the duct.

6. The image forming apparatus according to claim 5, further comprising an exhaust port provided at the downstream end of the duct in a direction of the flowing of the air of the duct.

7. The image forming apparatus according to claim 4, wherein the VOC removing unit is provided at an upstream end of the duct with respect to the direction of air flowing in the duct due to the operation of the suction device.

8. The image forming apparatus according to claim 1, further comprising:

a second suction device provided on the post-processing apparatus, that sucks the air from the space above the discharge tray to lead the air to pass through the air passage to reach the opening;

wherein an airflow of the suction device in the image forming apparatus main body is larger than the airflow of the second suction device provided on the post-processing apparatus.

* * * * *